US007027002B2

(12) United States Patent
Suh et al.

(10) Patent No.: US 7,027,002 B2
(45) Date of Patent: Apr. 11, 2006

(54) PLANAR WIDEBAND ANTENNAS

(75) Inventors: Seong-Youn Suh, Blacksburg, VA (US); Warren L. Stutzman, Blacksburg, VA (US)

(73) Assignee: Virginia Tech Intellectual Properties, Inc., Blacksburg, VA (US)

( * ) Notice: Subject to any disclaimer, the term of this patent is extended or adjusted under 35 U.S.C. 154(b) by 0 days.

(21) Appl. No.: 10/960,488

(22) Filed: Oct. 8, 2004

(65) Prior Publication Data

US 2005/0062670 A1 Mar. 24, 2005

Related U.S. Application Data

(62) Division of application No. 10/359,224, filed on Feb. 6, 2003, now Pat. No. 6,842,141.

(60) Provisional application No. 60/354,479, filed on Feb. 8, 2002, provisional application No. 60/354,475, filed on Feb. 8, 2002.

(51) Int. Cl.
*H01Q 13/00* (2006.01)

(52) U.S. Cl. ..... 343/773; 343/846

(58) Field of Classification Search ..... 343/773, 343/829, 846

See application file for complete search history.

(56) References Cited

U.S. PATENT DOCUMENTS 2,175,252 A * 10/1939 Carter ..... 343/773
2,611,869 A * 9/1952 Willoughby ..... 343/727
3,401,387 A * 9/1968 Milligan et al. ..... 343/767
4,163,236 A 7/1979 Kaloi ..... 343/700 MS
4,521,783 A * 6/1985 Bryans et al. ..... 343/781 R
4,893,612 A * 1/1990 Dawson ..... 126/689
4,903,033 A 2/1990 Tsao et al. ..... 343/700 MS
5,166,698 A * 11/1992 Ashbaugh et al. ..... 343/783
5,926,137 A 7/1999 Nealy ..... 343/700 MS
5,929,813 A 7/1999 Eggleston ..... 343/700 MS
6,057,802 A 5/2000 Nealy et al. ..... 343/700 MS

OTHER PUBLICATIONS

Wide-Band Planar Monopole Antennas: N. Agrawall, G. Kumar, and K. P. Ray; IEEE Transactions on Antennas and Propagation, vol. 46, No. 2; Feb. 1998.

A Disk Monopole Antenna With 1:8 Impedance Bandwidth and Omnidirectional Radiation Pattern; S. Honda, M. Ito, H. Seki and Y. Jinbo; Proceedings of ISAP92, Apporo. Japan pp. 1145-1148.

A Broadband Omnidirectional Antenna; R. M. Taylor, Computer Sciences Corp., 1994, IEEE 1294.

(Continued)

*Primary Examiner*—Tho Phan
(74) *Attorney, Agent, or Firm*—Whitham, Curtis & Christofferson, PC

(57) ABSTRACT

Wideband antennas with omnidirectional coverage have both military and commercial applications. In one embodiment, the Planar Inverted Cone Antenna (PICA) is composed of a single flat element vertically mounted above a ground plane. A geometry of Planar Inverted Cone Antenna (PICA) is based on the conventional circular-disc antenna with trimmed top part having the shape of a planar-inverted cone. in a second embodiment, the Fourpoint antenna also provides balanced impedance over the operating band and has useful radiation patterns and dual polarization over its operating frequency.

7 Claims, 26 Drawing Sheets

OTHER PUBLICATIONS

Planar Trapexoidal and Pentagonal Monopoles With Impedance Bandwidth in Excess of 10:1; J. A. Evans and M. J. Ammann; Dept. Of Electrical & Communication Engineering Dublin Institute of Technology, 1999, IEEE International Symposium, vol. 3.

* cited by examiner

PLANAR WIDEBAND ANTENNAS

CROSS REFERENCE TO RELATED APPLICATIONS

This is a divisional patent application based on application Ser. No. 10/359,224, filed Feb. 6, 2003 now U.S. Pat. No. 6,842,141 which was based on provisional patent applications Ser. No. 60/354,479 filed Feb. 8, 2002 by Seong-Youp Suh and Warren L. Stutzman for "Planar Inverted Cone Antenna", and Ser. No. 60/354,475 filed Feb. 8, 2002 by Seon-Youp Suh and Warren L. Stutzman for "Fourpoint Antenna", the contents of which are incorporated herein by reference.

STATEMENT OF GOVERNMENT INTEREST

This invention was made with government support under Contract Number N00014-00-1-0549 awarded by the Office of Naval Research. The government has certain rights to the invention.

BACKGROUND OF THE INVENTION

1. Field of the Invention

The present invention generally relates to wideband antennas with compact and planar geometry and, more particularly, to planar inverted cone and fourpoint antennas.

2. Background Description

The need for wideband antennas with omnidirectional coverage is increasing in military and commercial applications. Thin antennas are preferred in most situations. The classic solution is to obtain an omnidirectional pattern uses a thin wire dipole or its counterpart monopole version with a ground plane (if a half-space is to be eliminated). However, the wire dipole and monopole suffer from narrow impedance bandwidth. The bandwidth can be widened by using flat metal rather than a thin wire structure. Many flat radiator geometries have been explored over several decades. However, most such antennas suffer from pattern degradation at the high end of their impedance bandwidth.

Crossed half circle flat radiators have also been investigated and appear to provide better patterns within impedance bandwidth, but simulation results reveal that they have high cross polarization over the entire band due to the interaction between flat elements.

A flat circular disc antenna was used as a TV antenna operating at 90–770 MHz and described by S. Honda in 1992. (S. Honda, M. Ito. H. Seki and Y. Jinbo, "A disc monopole antenna with 1:8 impedance bandwidth and omnidirectional radiation pattern", *Proc. ISAP* '92 (Sapporo, Japan), pp. 1145–1148, September 1992). The circular disc antenna is composed of a flat circular disc 1 mounted above and perpendicular to a ground plane 2 as shown in FIG. 1. The circular disc antenna has a very large impedance bandwidth, about 10:1. A circular disc antenna of diameter A=25 mm, made of 0.5 mm thick brass plate mounted at height h=0.7 mm over a square ground plane (30 cm×30 cm) yielded acceptable impedance (VSWR<2) over the operating band from 2.25 to 17.25 GHz for a bandwidth of 7.7:1 as shown in P. P. Hammoud and F. Colomel. "Matching the input impedance of a broadband disc monopole", *Electronic Letters*, Vol. 29, pp. 406–407, February 1993. However, the radiation patterns of the circular disc antenna degrade at the high end of the band. The direction of the conical beam maxima in the E-plane pattern vary from 30° to 60° in elevation as frequency increases from 2.5 to 9.0 GHz, whereas in the H-plane the pattern remains somewhat omnidirectional with maximum variation in azimuth increasing from 4 dB to 7 dB over the band as described in N. P. Agrawall, G. Kumar, and K. P. Ray, "Wide-band Planar Monopole Antennas", *IEEE Transactions on Antennas and Propagation*, Vol. 46, No. 2, pp. 294–295, February 1998.

Several modified flat monopole antennas were proposed by N. P. Agrawall, G. Kumar, and K. P. Ray in "Wide-band Planar Monopole Antennas", *IEEE Transactions on Antennas and Propagation*, Vol. 46, No. 2, pp. 294–295, February 1998, to obtain better impedance bandwidth. They are elliptical, square, rectangular, and hexagonal shaped flat monopoles. An elliptical disc monopole antenna having an ellipticity ratio of 1.1 yields the best performance. However, the modified flat monopole antennas still suffer from radiation pattern degradation in E-plane.

A trapezoidal shape flat monopole antenna shown in FIG. 2 has been proposed as a variation of square flat monopole antenna by J. A. Evans and M. J. Ammann, "Planar Trapezoidal and Pentagonal monopoles with impedance bandwidth in excess of 10:1", *IEEE International Symposium Digest* (Orlando), Vol. 3, pp. 1558–1559, 1999. The trapezoidal radiating element 3 is mounted above and perpendicular to the ground plane 4. The impedance bandwidth of the antenna was optimized by tapering the lower base 5 near the ground plane 4. However, the trapezoidal flat monopole antenna does not solve the problem of variations in tilt angle of the E-plane pattern peak.

A crossed half disc antenna shown in FIGS. 3A and 3B was proposed as a variation of the bow-tie antenna described by R. M. Taylor, "A broadband Omnidirectional Antenna", *IEEE Antennas and Propagation Society International Symposium Digest* (Seattle), Vol. 2, pp. 1294–1297, June 1994. The crossed flat (i.e., planar) elements 6, 7 and 8, 9 improve the antenna pattern over the impedance bandwidth compared to a single half disc element. The dotted circle inside of the half disc 7 in FIG. 3B represents the size of a circular disc having similar impedance bandwidth. The crossed half disc antenna is about double the size of the circular disc antenna.

Typical specification for omnidirectional antennas from 0.5 to 18 GHz require ±2.0 dB pattern variation from omnidirectional, 0 dBi gain, and 3:1 Voltage Standing Wave Ratio (VSWR). The crossed half disc antenna of FIGS. 3A and 3B maintains the pattern and gain specifications over a much broader bandwidth, with a 2:1 VSWR from 0.5 to 18 GHz.

However, cross polarization can be high. Additionally, there are many applications in both industry and government for a wideband, low-profile, polarization diverse antenna. Communication systems, including commercial wireless communications, often require antennas that cover several frequency bands simultaneously. Another desirable feature is that of dual polarization to support polarization diversity, polarization frequency reuse, or polarization agile operation.

Wideband antenna research at VTAG (Virginia Tech Antenna Group) began in 1994 and has resulted in several inventions. Of specific interest are two patents for the Foursquare antenna: J. R. Nealy, "Foursquare Antenna Radiating Element," U.S. Pat. No. 5,926,137, and Randall Nealy, Warren Stutzman, J. Matthew Monkevich, William Davis, "Improvements to the Foursquare Radiating Element-Trimmed Foursquare," U.S. Pat. No. 6,057,802.

The operating band of an antenna spans a lower operating frequency $f_L$ to an upper operating frequency $f_U$. The center frequency is denoted as $f_C=(f_U+f_L)/2$. The operating band limits $f_L$ and $f_U$ are determined by acceptable electrical performance. For wideband antennas, this is usually the input VSWR referenced to a specified impedance level. For example, a popular specification is the VSWR≦2 over the band $f_L$ to $f_U$ for an input impedance of 50 Ω. Bandwidth defined as a percent of the center frequency is $Bp=(f_{U-fL})/f_C \times 100\%$. Bandwidth defined as a ratio is $Br=f_U/f_L$.

The Foursquare antenna, as described in U.S. Pat. No. 5,926,137, is shown in FIGS. 17A and 17B. It comprises four square radiating elements 11, 12, 13, and 14 on the top side of a dielectric substrate 15 which is separated from a ground plane 16 by a foam separator 17. At least two coaxial feeds 18 and 19 connect to interior corners of opposing pairs of radiating elements. This Foursquare antenna provides wideband performance and several practical advantages for commercial and military applications. Its features are a low-profile geometry, dual polarization, compact radiating element size; these features make it ideal for use as an array element. The Foursquare antenna provides dual, orthogonal polarizations naturally, but these polarization outputs can be processed to produce any polarization state.

The diagonal length, $\sqrt{2}A$, of the antenna is about $\lambda_L/2$ and the height "h" of the element above the ground plane is about $\lambda_U/4$, where $\lambda_L$ and $\lambda_U$ represent wavelength at the lower and upper operating frequencies $f_L$ and $f_U$.

Several Foursquare antenna models have been constructed and tested. FIGS. 18A and 18B show the computed and measured impedance and VSWR (Voltage Standing Wave Ratio) curves of the Foursquare antenna in FIGS. 17A and 17B with the dimensions listed in Table 1.

TABLE 1

| Description | Symbol | Size |
|---|---|---|
| Element side length | A | 21.3 mm (0.84") |
| Substrate side length | C | 21.8 mm (0.86") |
| Gap width | W | 0.25 mm (0.01") |
| Substrate thickness | $t_s$ | 0.7 mm (0.028") |
| Foam thickness | $t_d$ | 6.4 mm (0.25") |
| Element height above ground plane | h | 7.06 mm (0.278") |
| Feed position distance | F' | 4.3 mm (0.17") |

A dielectric constant 2.33 of the dielectric substrate was used in both simulation and measurement. The Foursquare antenna was simulated using the Fidelity code from Zeland software (Fidelity User's Manual, Zeland Software Inc., Release 3, 2002). Fidelity uses the Finite Difference Time Domain (FDTD) method to perform numerical computation. The measured and calculated impedance associated VSWR (into 50 Ω) are plotted in FIGS. 18A–B. The agreement between measured an calculated results indicates that accurate studies can be performed by simulation. The resistance of the antenna is about 50 Ω over the operating band and the reactance of the antenna is mostly inductive.

FIGS. 19A and 19B show the measured radiation patterns of the Foursquare antenna at 6 GHz. The E-plane pattern is the radiation pattern measured in a plane containing feed; see FIGS. 17A and 17B. The H-plane pattern is the radiation pattern in a plane orthogonal to the E-plane. The patterns at other frequencies are similar to the patterns at 6 GHz in FIGS. 19A and 19B.

U.S. Pat. No. 5,926,137 also shows a cross-diamond antenna as a modification of the basic Foursquare antenna. The construction of the cross-diamond antenna is the same as Foursquare antenna. The cross-diamond radiating elements are shown in FIG. 8 of U.S. Pat. No. 5,926,137 and comprise four diamond-shaped metal plates with included angles $\alpha_1$ and $\alpha_2$, that may the be the same or different, depending on the application. A test model with the same outer dimensions with the Foursquare antenna listed in Table 1 and with angles $\alpha_1=60°$ and $\alpha_2=59.76°$ was constructed and measured. The measured data demonstrated that the cross-diamond antenna may be used in the same applications as the Foursquare antenna and has a bandwidth intermediate between conventional dipole antenna and the Foursquare antenna.

SUMMARY OF THE INVENTION

It is therefore an object of the present invention to provide new, compact antenna structures with significantly improved antenna performance over the prior art antennas.

According to a first embodiment of the invention, in order to overcome disadvantages of the above described disc antennas, a new monopole antenna has been invented. This new antenna is called the Planar Inverted Cone Antenna (PICA) and offers several advantages over previous monopole antennas. The Planar Inverted Cone Antenna (PICA), and its variations, is composed of single flat radiating element above a ground plane. The antenna geometry is very simple, having a shape of an inverted cone intersecting an elliptical curve, yet provides outstanding impedance and radiation pattern performance. The pattern of PICA does not degrade over a bandwidth up to 6:1 and has very low cross polarization. Investigations were performed through both computer simulations and experimental models. Simulation and measured data for the antennas are compared in terms of Voltage Standing Wave Ration (VSWR) and antenna patterns.

The operating band of an antenna spans a lower operating frequency $f_L$ to an upper operating frequency $f_U$. This operating from $f_L$ to $f_U$ band has acceptable electrical performance, usually determined by impedance (or VSWR). The primary application for the invention is for very wideband wireless communications. Bandwidth is defined as a ration as $BW=f_U/f_L$; for example, a 2:1 bandwidth means $f_U=2f_L$.

The new wideband PICA has better omnidirectional radiation with smaller antenna size than a circular disc or half disc antenna. Simulation data demonstrates that the PICA yield twice the pattern bandwidth than other disc antennas, Also, its impedance bandwidth is similar to disc or half disc antennas.

According to the second embodiment of the invention, a new Fourpoint antenna is provided which enhances the performance of the Foursquare antenna. The Fourpoint antenna improves the performance of the Foursquare antenna dramatically without increasing mechanical size. Changes in the antenna physical geometry and the introduction of a tuning plate have a significant influence in the antenna performance. Inclusion of a tuning plate in the Fourpoint and Foursquare antenna increases the bandwidth by extending the high end of the operating band. The new shape allows achieving balanced impedance over the operating band and dual polarization over its operating frequency. The addition of a tuning plate also improves significantly bandwidth through extension of the high end of the frequency band. The present invention also provides a variation of the Foursquare and Fourpoint radiation elements by adding metal tabs to the vertices of the radiating elements, which allows a reduction in antenna size, maintaining similar antenna performance.

The Fourpoint antenna has been designed, modeled, constructed, and measured at VTAG. The computed and measured data are presented to validate the enhanced performance of the Fourpoint antenna. Variations of the Fourpoint and Foursquare antenna also reduce the antenna size and are useful for elements in an array system.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF THE PREFERRED EMBODIMENTS OF THE INVENTION

Figure 1:
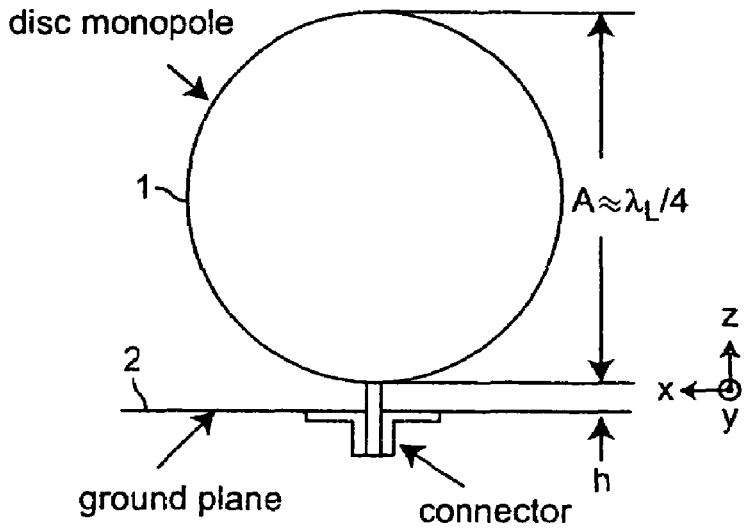
Figure 1 PRIOR ART
FIG. 1 is a plan view of a circular disc antenna over a ground plane.
Figure 2:
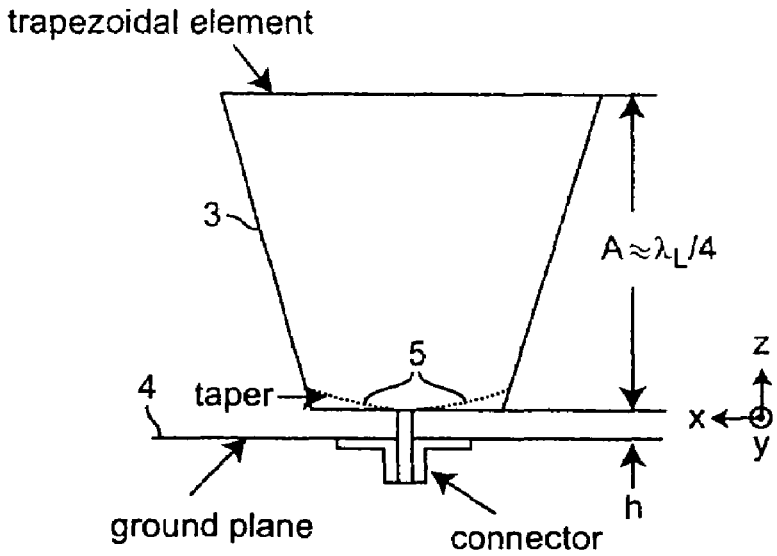
Figure 2 PRIOR ART
FIG. 2 is a plan view of a trapezoidal planar monopole antenna above a ground plane.
Figure 4A:
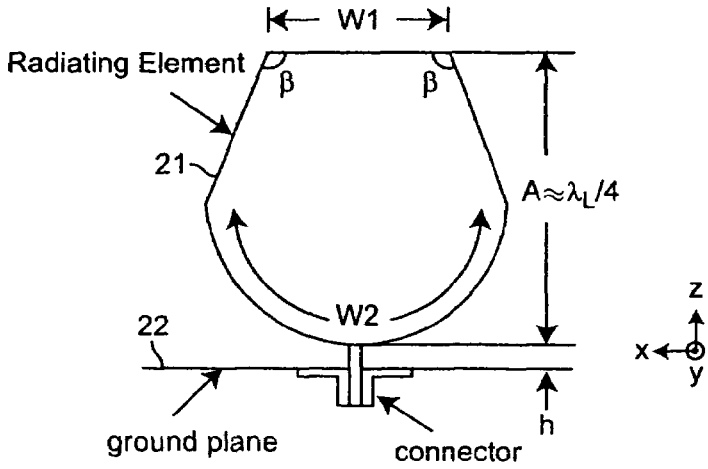
FIG. 4A is a plan view showing the geometry of the general shape of a Planar Inverted Cone Antenna (PICA) according to the a first embodiment of the invention.
Figure 4B:
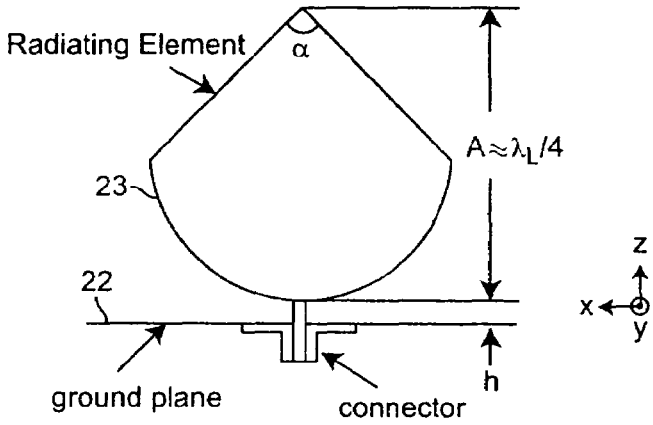
FIG. 4B is a plan view of a specific modification of the Planar Inverted Cone Antenna of the first embodiment of the invention.

Referring now to FIGS. 4A and 4B of the drawings, there is shown the geometries of the antenna according to the first embodiment of the invention. This embodiment is based on the conventional circular disc antenna of FIG. 1 and has similar impedance bandwidth and improved antenna pattern, but has smaller area than the circular disc antenna. FIG. 4A shows a general geometry of the antenna according to the first embodiment of the invention. The antenna comprises a radiating element 21 having a shape of a truncated inverted cone intersecting an elliptical curve. This radiating element is positioned above and perpendicular to a ground plane 22. Dimension W1 of the truncated cone could have arbitrary shape and size based on the specific application. However, the edge W2 should be tapered with smoothly rounded shape such as circular, elliptical, tangential, or Chebyshev-tappered shape to obtain broad impedance bandwidth. For some applications, the edge W2 could be modified with a piecewise linear geometry. In FIG. 4B, the radiating element 23 is in the form of an inverted cone intersecting an elliptical curve, where the cone part is not truncated as in FIG. 4A. The cone angle, a, in FIG. 4B can be varied to obtain optimum performance.

The difference between this design and others, such as the circular disc and half disc flat radiation elements, is that the Planar Inverted Cone Antenna (PICA) shape leads to an improved radiation pattern, while maintaining similar impedance characteristics and the proposed antenna is smaller.

Figure 5:
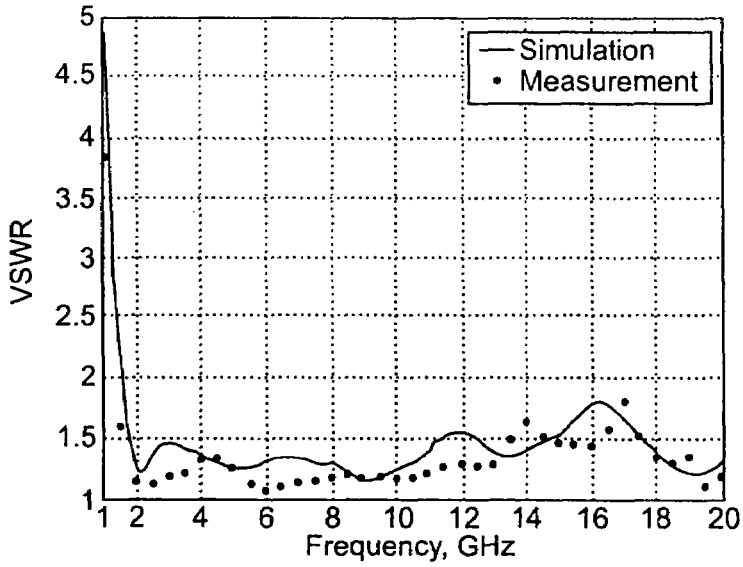
FIG. 5 is a graph showing computed (solid curve) and measured (dotted curve) VSWR for the PICA of FIG. 4B with A=50.8 mm, $\alpha$=80°, and h=0.64 mm.
Figure 6A:
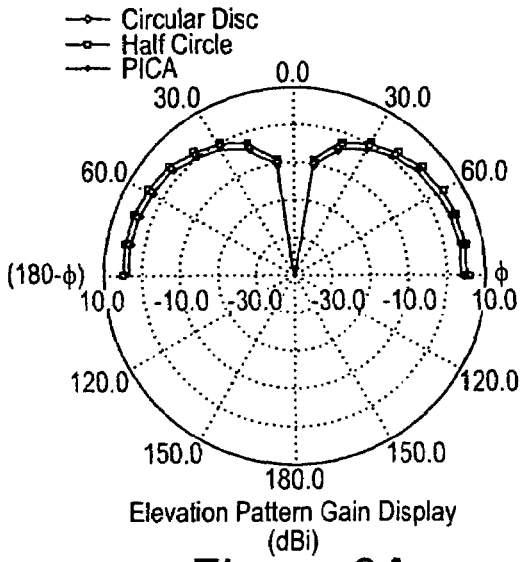
FIG. 6A is a polar graph showing an elevation pattern of a disc antenna at 2 GHz.
Figure 6B:
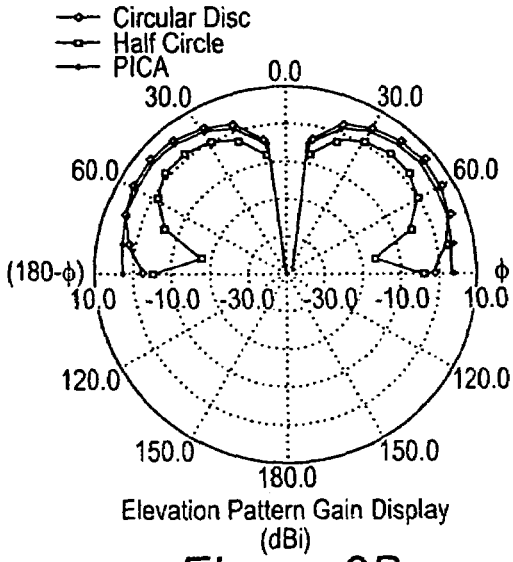
FIG. 6B is a polar graph showing an elevation pattern of a disc antenna at 5 GHz.
Figure 6C:
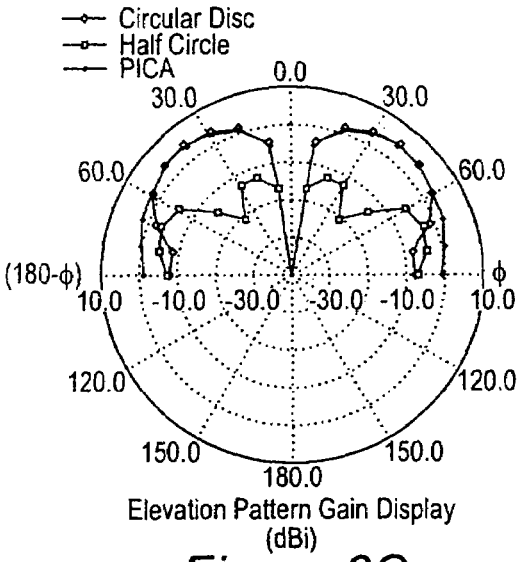
FIG. 6C is a polar graph showing an elevation pattern of a disc antenna at 7 Ghz.
Figure 6D:
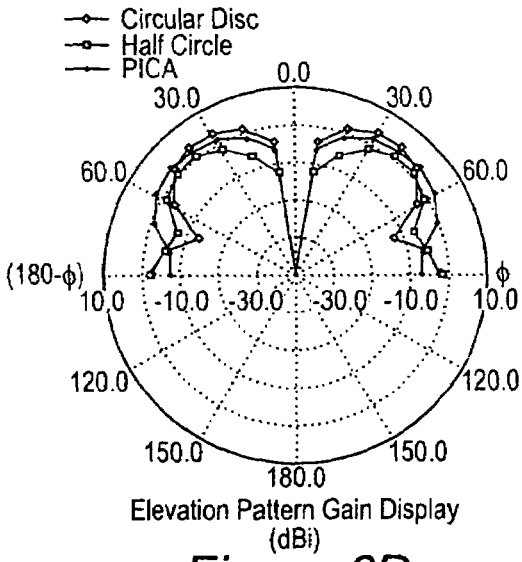
FIG. 6D is a polar graph showing an elevation pattern of a disc antenna at 9 Ghz.

A test model of the specific PICA in FIG. 4B with dimensions of A=50.8 mm (2.0"), $\alpha$=80°, and h=0.64 mm (0.025") was investigated using both simulations and measurements. The test antenna was simulated using the Fidelity code from Zeland Software described by Fidelity User's Manual, Zeland Software Inc., Release 3, 2000. Fidelity uses the Finite Difference Time Domain (FDTD) method to perform numerical computation. The antenna was also constructed from a tin plate. The VSWR curves referenced to a 50 Ω input impedance are shown in FIG. 5 for simulation and measured results. The VSWR curve for simulation is well below 2:1 from 1.5 to 20 GHz. It is evident that acceptable operation exists above 1.5 GHz. The PICA has an ultra wideband impedance bandwidth. The agreement between measured and calculated results indicates design studies can be performed by simulation. The difference at high frequencies between simulation and measurement is due to the reflected-wave power in measurement facility, the SMA connector and the rough edge at the bottom of PICA. The electrical size of the PICA at 1.5 GHz is about 0.25λ.

Far field radiation patterns (elevation patterns. $E_\theta$) were computed for the PICA, as well as the circular disc and half disc antennas. The radiation patterns are compared in FIGS. 6A to 6D for several frequencies. These patterns show that the circular disc and half disc antenna suffer from pattern degradation as frequency increases beyond 3:1 impedance bandwidth, while there is no significant pattern variation with the PICA up to a 6:1 impedance bandwidth. The elevation patterns ($E_\theta$) for the antennas were computed in the plane containing the flat area of the antennas ($\phi$=90°). Cross polarization patterns ($E_\theta$) are not displayed, but are about 20 dB below the co-polarized pattern for the PICA.

Figure 7A:
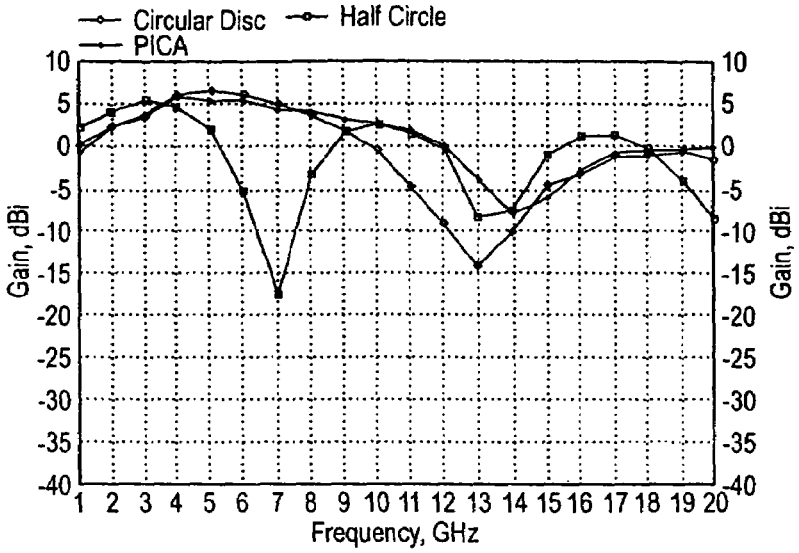
FIG. 7A is a graph showing computed antenna gains for the circular disc, half disc, and PICA antennas as a function of frequency for selected elevation angles $\theta$=50° and $\phi$=90°.
Figure 7B:
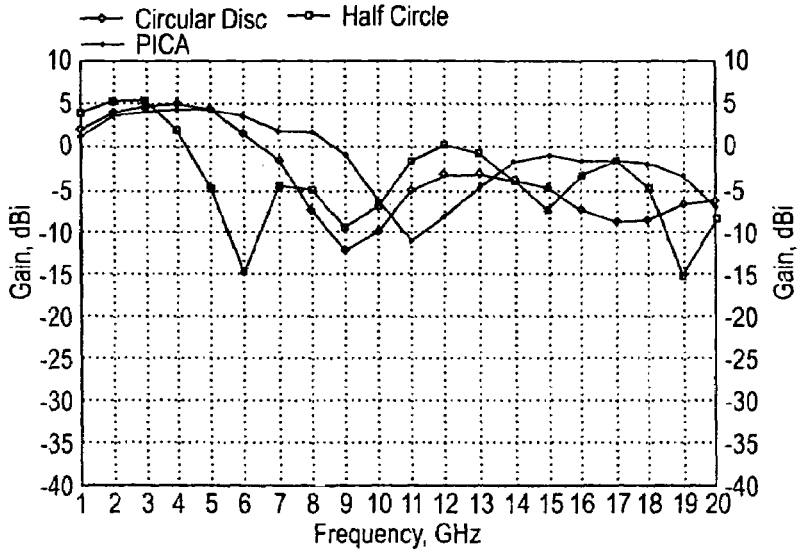
FIG. 7B is a graph showing computed antenna gains for the circular disc, half disc, and PICA antennas as a function of frequency for selected elevation angles $\theta$=70° and $\phi$=90°.
Figure 7C:
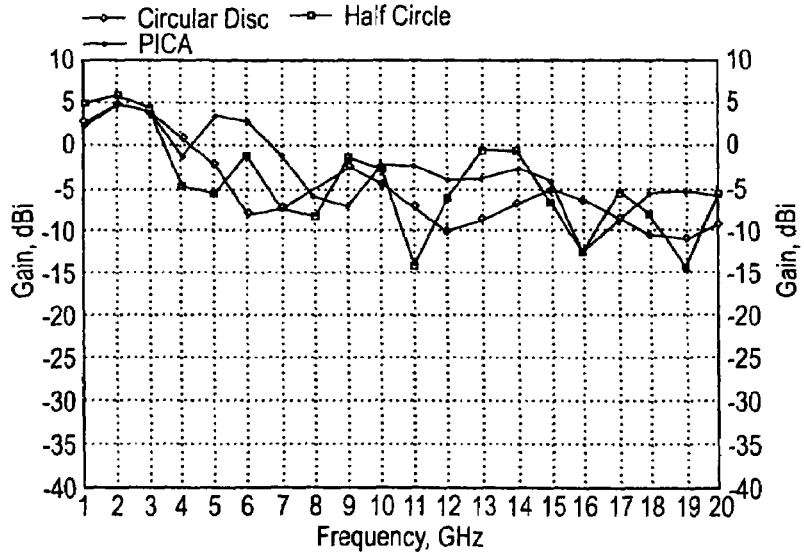
FIG. 7C is a graph showing computed antenna gains for the circular disc, half disc, and PICA antennas as a function of frequency for selected elevation angles $\theta$=90° and $\phi$=90°.

Antenna gain was also computed at several elevation angles, $\theta$, for $\phi$ fixed at 90°. Computed gain is displayed in FIGS. 7A, 7B and 7C for three antennas. The PICA has superior gain performance. The elevation pattern and gain at $\phi$=0° are not presented but are similar to, or even better than, the ones at $\phi$=90°.

Figure 3A:
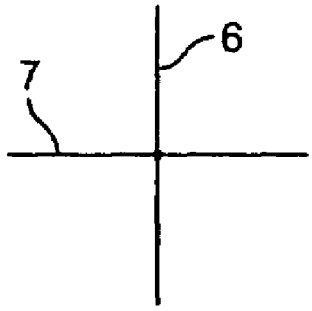
Figure 3A PRIOR ART
FIGS. 3A and 3B, are respectively a top view and a plan view of a crossed half disc antenna.
Figure 3B:
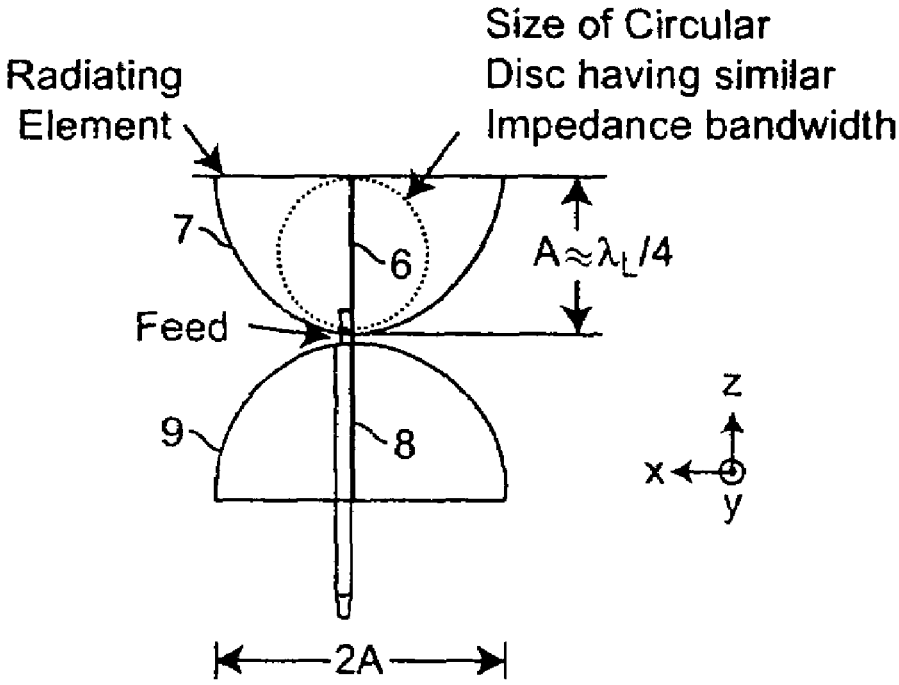
Figure 3B PRIOR ART
Figure 8A:
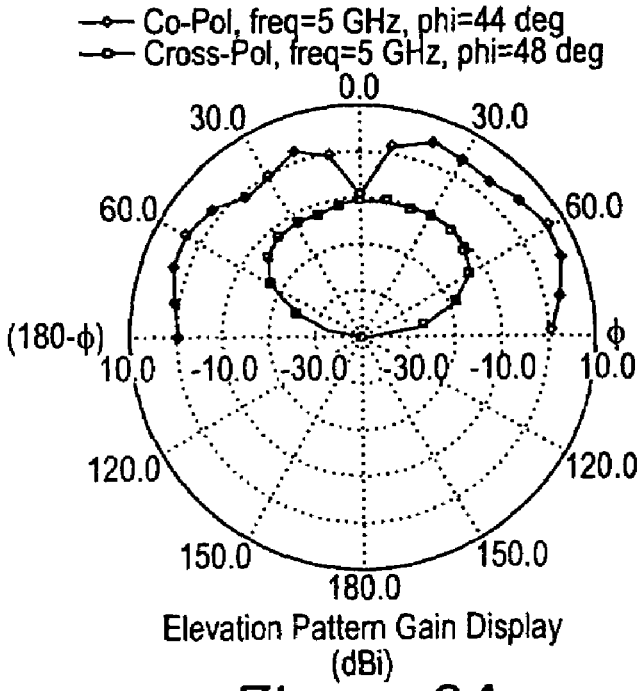
FIG. 8A is a polar graph showing a computed radiation pattern at $\phi$=40° for the crossed half disc antenna at 5 Ghz.
Figure 8B:
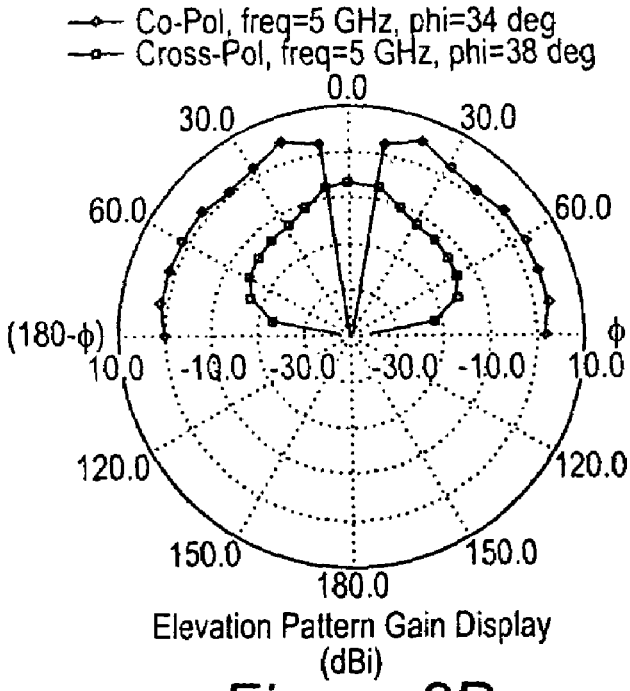
FIG. 8B is a polar graph showing a computed radiation pattern at $\phi$=90° for the crossed half disc antenna at 5 Ghz.

A modification of the first embodiment of the present invention is the Crossed Planar Inverted Cone Antenna (Crossed PICA). The idea of crossed planar discs in a monopole configuration was investigated by Taylor in R. M. Taylor, "A broadband Omnidirectional Antenna," IEEE Antennas and Propagation Society International Symposium Digest (Seattle), Vol. 2, pp. 1294–1297, June 1994 with the goal of improving the antenna radiation pattern. A crossed half disc antenna with dimension A=50.8 mm in FIG. 3 was simulated to determine the level of cross-polarization. Even though the crossed half disc antenna enhanced the co-polarization component increased considerably to a level of about −10 dB. Representative computed patterns at 5 GHz in FIGS. 8A and 8B show co-pol and cross-pol components for angles $\phi=40°$ and $\phi=90°$.

Figure 9:
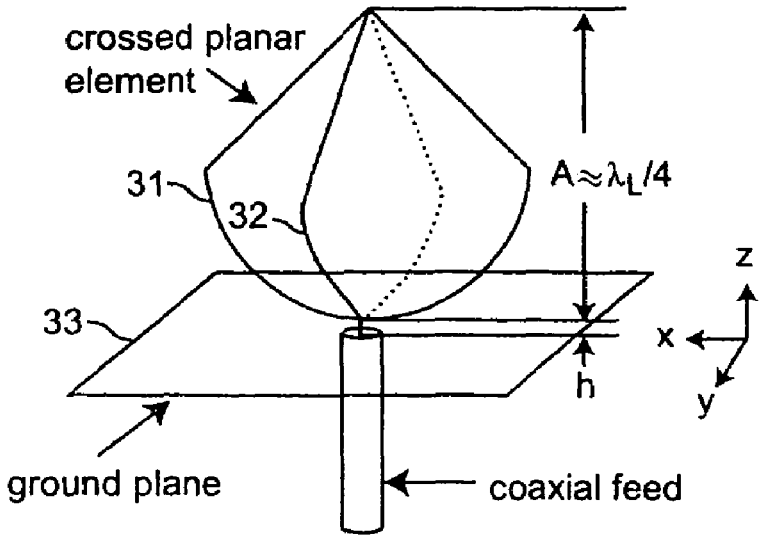
FIG. 9 is an isometric view showing a geometry of the crossed Planar Inverted Cone Antenna (crossed PICA) according the invention.

Even though the single PICA has excellent co- and cross-polarized antenna patterns, a crossed PICA antenna was examined to see if even lower cross-pol content could be achieved. The geometry of the crossed PICA antenna is shown in FIG. 9. The antenna has two elements 31 and 32 of the same size and shape that are perpendicular to one another and to a ground plane 33. The height "h" between the ground plane 33 and the base of the crossed elements 31 and 32 controls the overall level of the antenna impedance.

Figure 10:
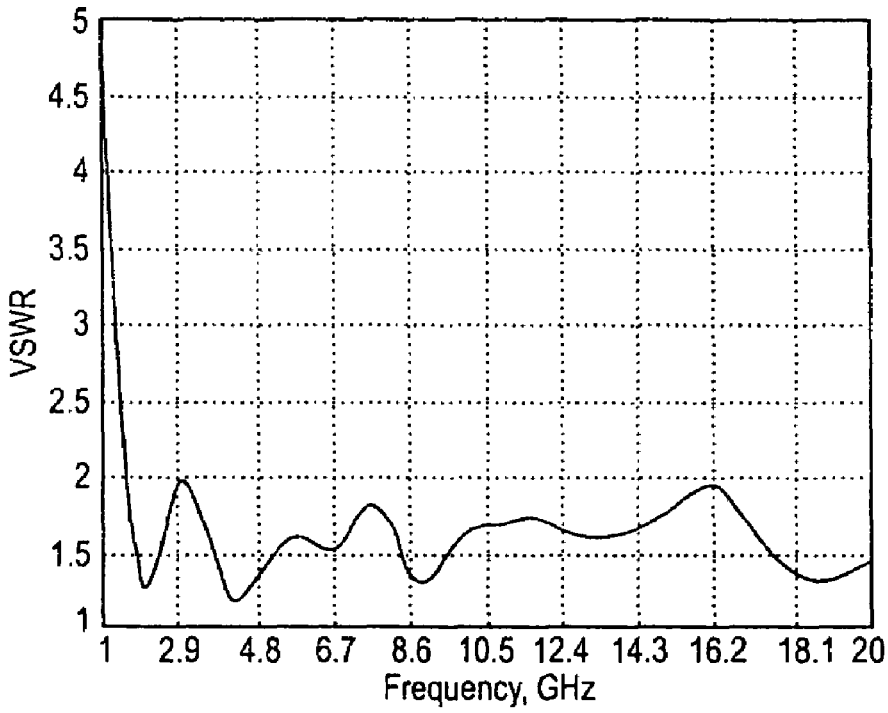
FIG. 10 is a graph showing a computed VSWR of the crossed PICA of FIG. 9 with A=50.8 mm, $\alpha$=80°, and h=1.3 mm.
Figure 11A:
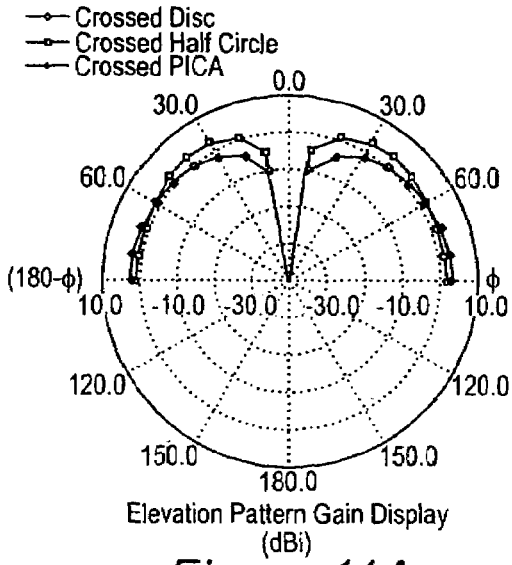
FIG. 11A is a graph showing an elevation pattern of the crossed planar antenna at 2 GHz.
Figure 11B:
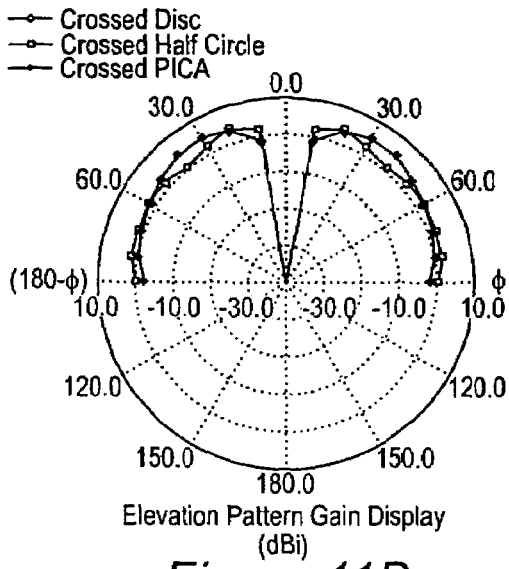
FIG. 11B is a graph showing an elevation pattern of the crossed planar antenna at 5 GHz.
Figure 11C:
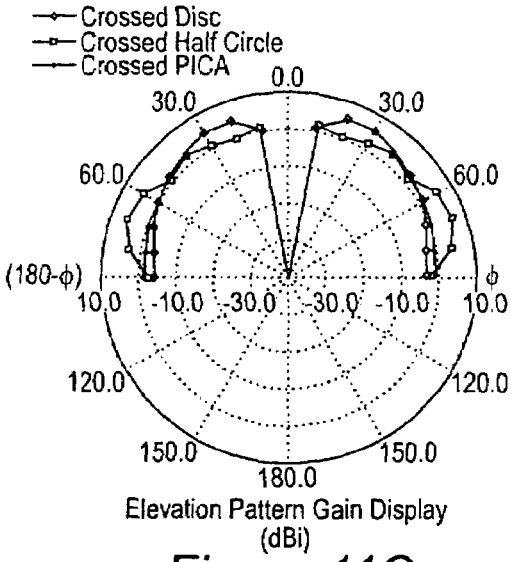
FIG. 11C is a graph showing an elevation pattern of the crossed planar antenna at 7 GHz.
Figure 11D:
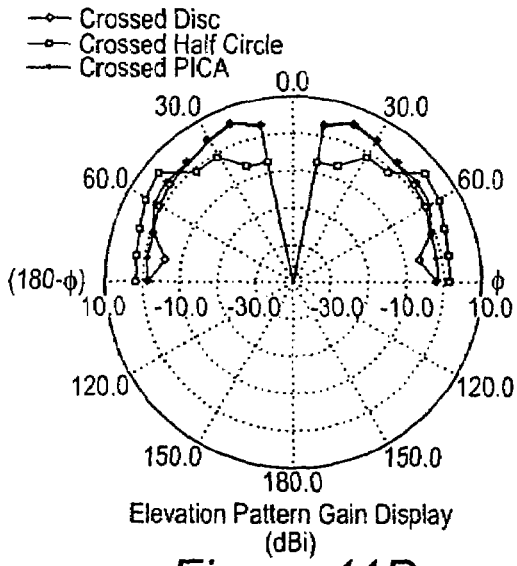
FIG. 11D is a graph showing an elevation pattern of the crossed planar antenna at 9 GHz.
Figure 12A:
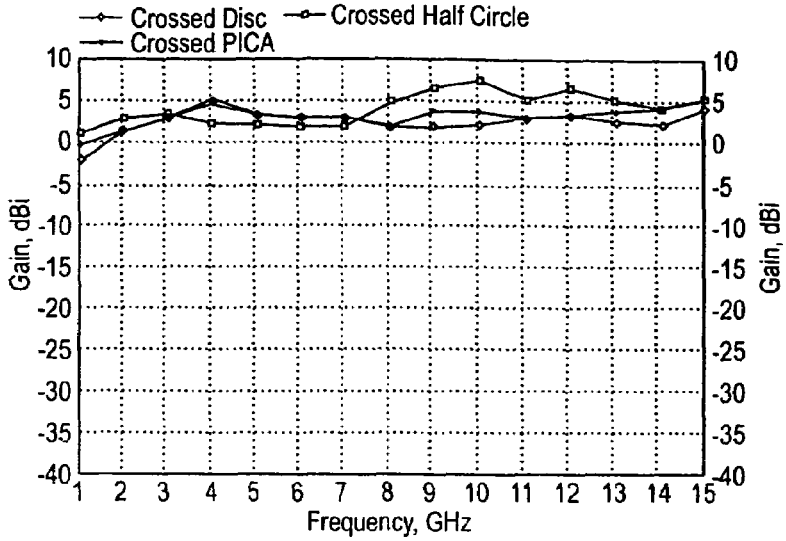
FIG. 12A is a graph showing a computed gain as a function of frequency for the crossed circular disc, crossed half disc and crossed PICA antennas for observation angles ($\theta$, $\phi$)=(50°, 90°)
Figure 12B:
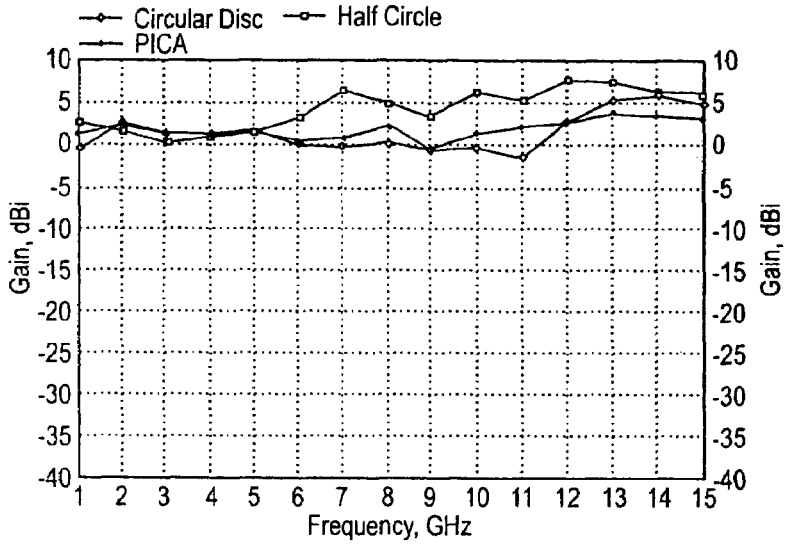
FIG. 12B is a graph showing a computed gain as a function of frequency for the crossed circular disc, crossed half disc and crossed PICA antennas for observation angles ($\theta$, $\phi$)=(70 , 90°)
Figure 12C:
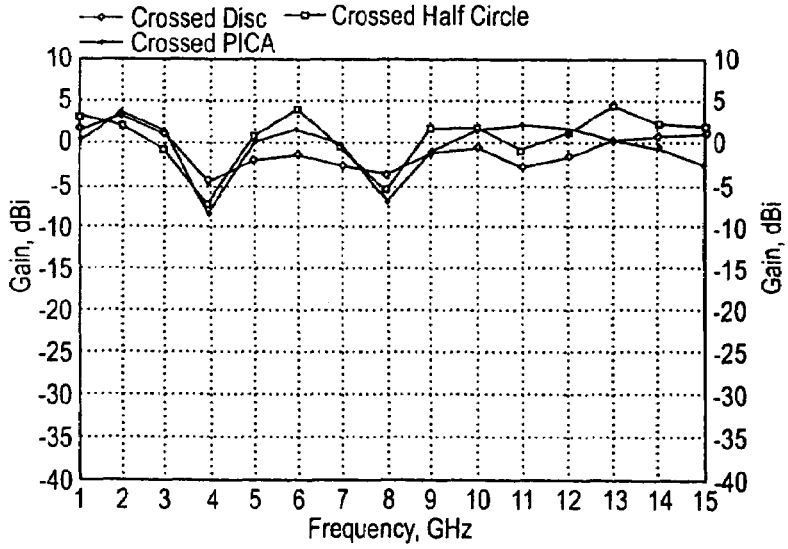
FIG. 12C is a graph showing a computed gain as a function of frequency for the crossed circular disc, crossed half disc and crossed PICA antennas for observation angles ($\theta$, $\phi$))=(90°, 90°)

The crossed PICA of FIG. 9 with A=50.8 mm (2.0"), $\alpha=80°$, and h=1.3 mm (0.05") was simulated. The height "h" in FIG. 9 is larger than the "h" of single PICA in FIG. 4B to optimize antenna impedance. Again, the Fidelity software used to model the antenna and to compute antenna characteristics. The antenna also was constructed with a tin plate of the same dimensions. The computed VSWR results are shown in FIG. 10 for a 50 Ω input impedance. The VSWR for the crossed PICA is only slightly worse than a single PICA (see FIG. 5) at the low-end of the band. This effect occurs for crossed circular disc, crossed half disc, and any other crossed planar antenna. Far field radiation patterns ($E_\theta$) for the crossed PICA are shown in FIGS. 11A to 11D for several frequencies over the impedance bandwidth. Computed gain for the crossed circular disc, crossed half disc, and crossed PICA antenna are compared in FIGS. 12A, 12B and 12C. Gain values are very stable over the impedance bandwidth. Cross-polarization patterns ($E_\phi$) are not shown, but the cross-polarization level is high on the order of −10 dB relative to the co-polarization pattern. Simulation data reveal that the crossed PICA also increases the cross-polarization content ($E_\theta$) due to an interaction between the two perpendicular plates, while it has similar impedance bandwidth with and better co-pol component and gain than the single PICA element.

It should be concluded that crossed planar element with plate geometries such as circular, elliptical, square, rectangular, hexagonal, trapezoidal, or any flat monopole element increases the cross-polarization level compared to a single flat monopole.

Figure 13A:
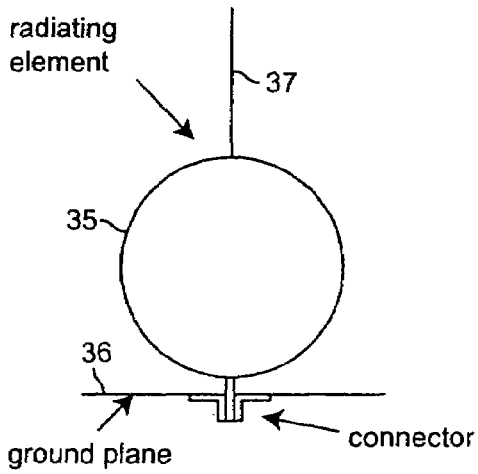
FIG. 13A is a plan view showing the geometry of a wideband wire-loaded circular disc antenna according to the invention.
Figure 13B:
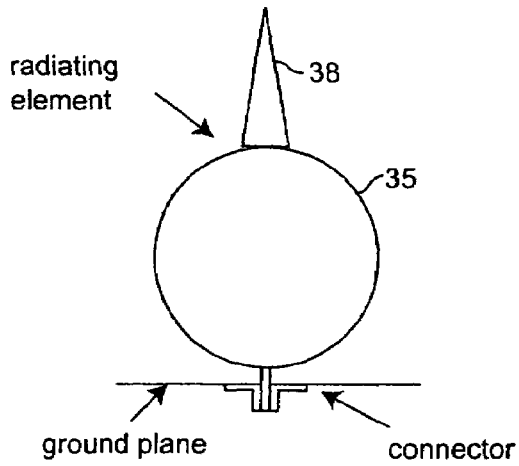
FIG. 13B is a plan view showing the geometry of a wideband triangular sheet-loaded circular disc antenna according to the invention.
Figure 13C:
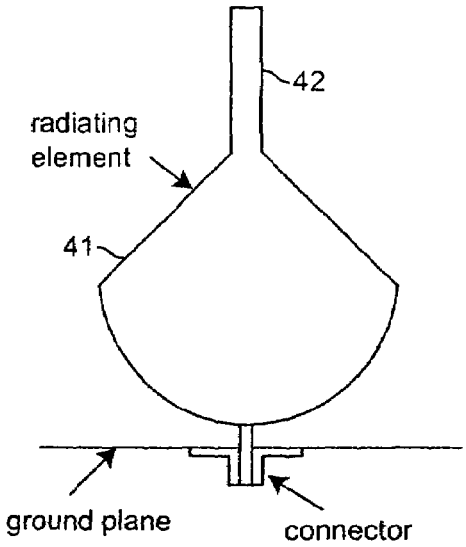
FIG. 13C is a plan view showing the geometry of a wideband rectangular sheet-loaded PICA according to the invention.
Figure 13D:
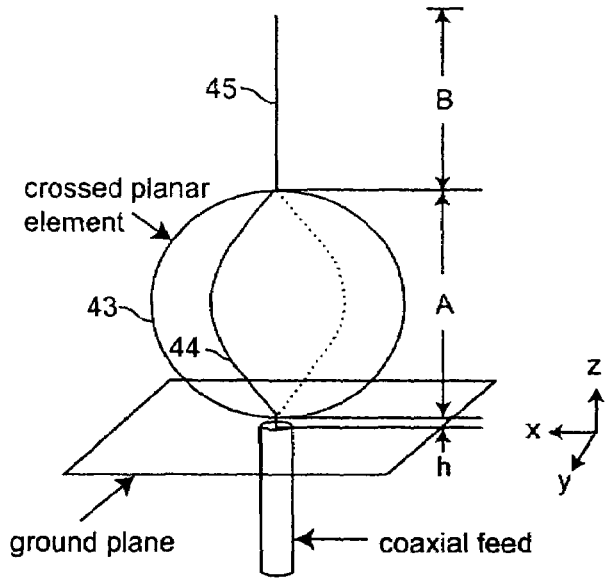
FIG. 13D is an isometric view showing the geometry of a wideband wire-loaded crossed circular disc antenna according to the invention.

Another modification of the first embodiment of the present invention is related to the wideband, dual-band disc antenna. The conventional single planar or crossed antennas were modified by adding a loading element on the top of the antenna. Example antennas of this modification are shown in FIGS. 13A to 13D. In FIG. 13A, a disc element 35 perpendicular to a ground plane 36 is provided with a wire loading element 37. In FIG. 13B, the disc element 35 is provided with a flat, triangular loading element 38. In FIG. 13C, a PICA element 41 is provided with a flat, rectangular loading element 42. In FIG. 13D, crossed disc elements 43 and 44 are provided with a wire loading element 45. In all these variations, the additional antenna element on the top can be any wire antenna such as a straight, helix, zigzag, or meander shape wire, as generally shown in FIG. 13A, or any flat antenna such as a rectangular or triangular shape plate, as shown in FIGS. 13B and 13C, respectively. These antennas could provide wideband dual-band impedance bandwidth. The dimensions can be modified depending on the applications. The total height of the antenna element is about $\lambda_L/4$ where $\lambda_L$ represents a wavelength at the lowest operating frequency.

Figure 14:
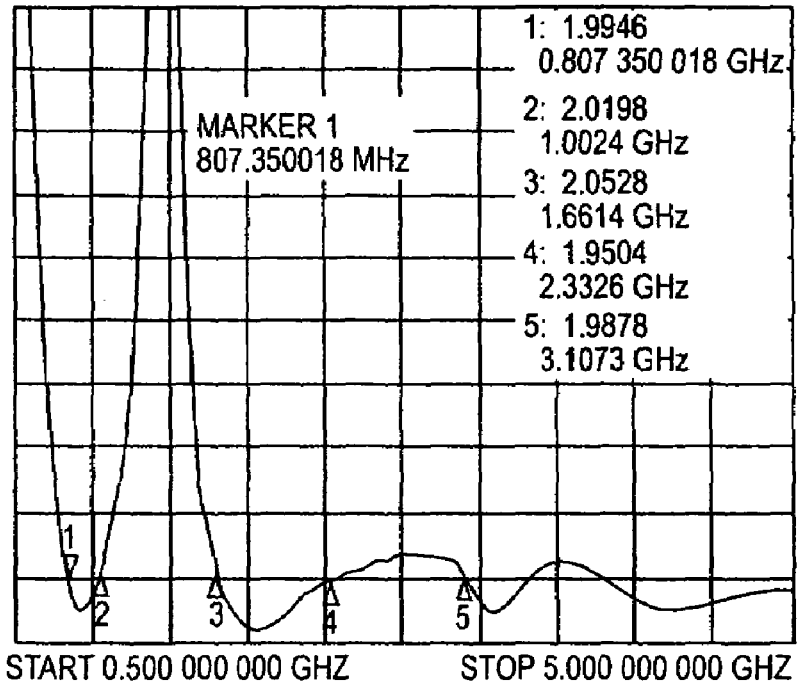
FIG. 14 is a graph showing measured VSWR of the wire-loaded crossed circular disc antenna of FIG. 13D with A=50.8 mm, B=58.4 mm, and h=1.27 mm.
Figure 15:
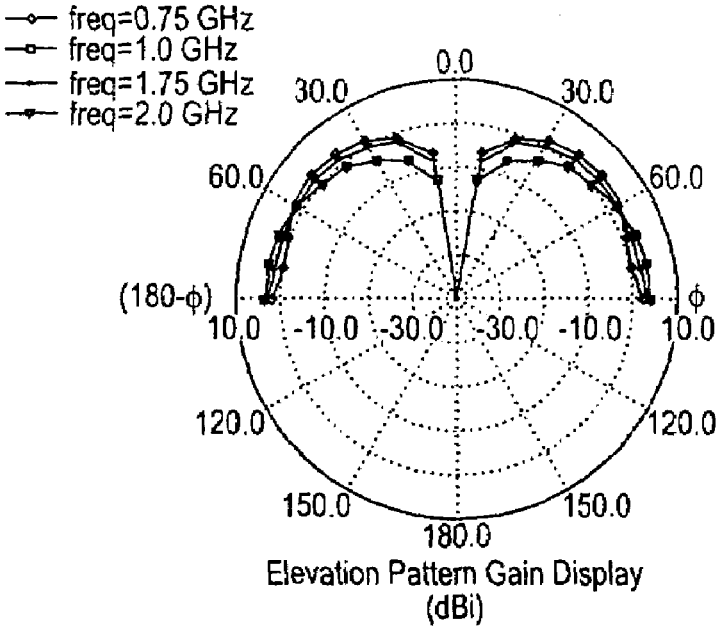
FIG. 15 is a polar graph showing computed elevation patterns (E) for wire-loaded circular disc antenna of FIG. 13D for several frequencies.
Figure 16:
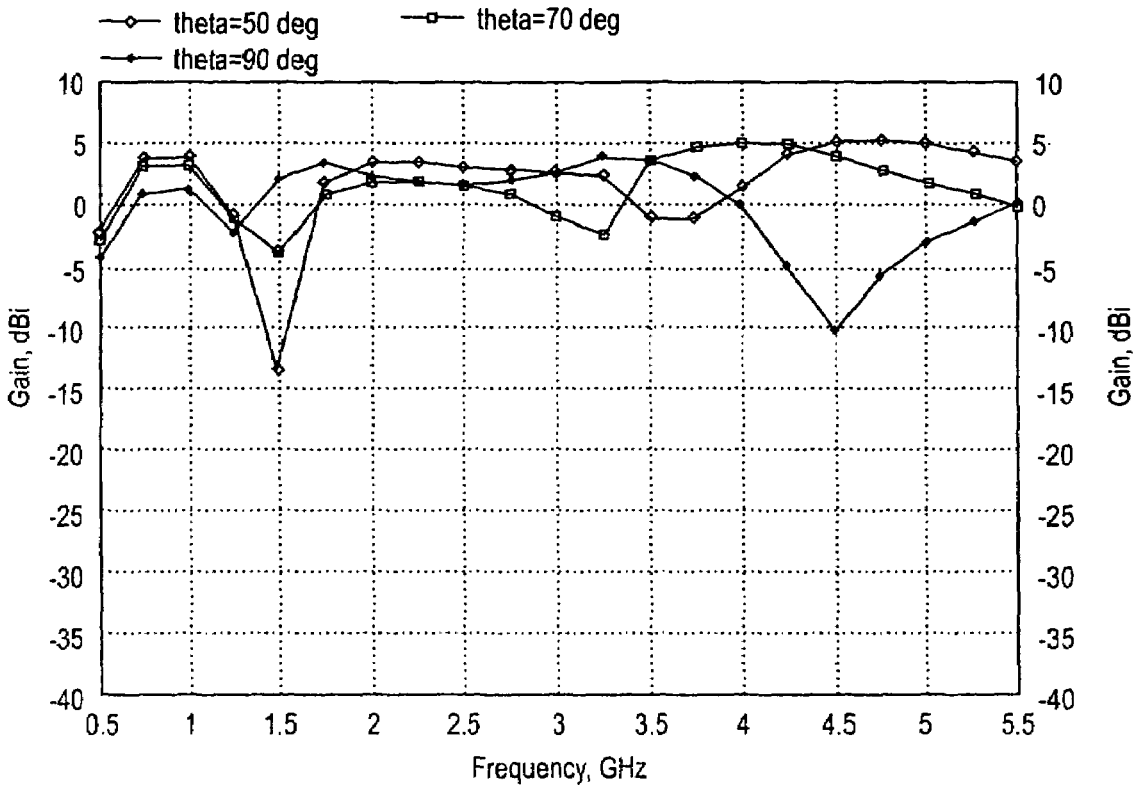
FIG. 16 is a graph showing computed gain as a function of frequency for the wire-loaded crossed circular disc antenna of FIG. 13D.

As a test model, a wire-loaded crossed circular disc antenna in FIG. 13D was constructed with wire-loaded crossed circular disc antenna and dimensions of A=50.8 mm (2.0"), B=58.4 mm (2.3"), and h=0.27 mm (0.05"). The measured VSWR curves are shown in FIG. 14 for a 50 Ω Input impedance. The antenna operates over the following two bands with VSWR 2: 807–1002 MHz and 1661–2333 MHz. These bands cover typical commercial bands such as AMPS, GSM, DCS, and PCS. Antenna size can be reduced further by dielectric material loading or employing a helical shaped wire top element. Computed far field radiation patterns for the antenna are shown in FIG. 15 at several frequencies over impedance bandwidth. The antenna pattens in both bands are acceptable. The computed gain for the wire-loaded crossed circular disc antenna is plotted in FIG. 16.

The second embodiment of the present invention is the Fourpoint antenna which improves the performance of the Foursquare antenna and cross-diamond antenna in the same size. Better performance can be obtained by adding capacitive reactance at the high end of the frequency band to achieve a net reactance that is close to zero over the band. This is the concept of the Foursquare antenna. The data, tabulated in Table 2, show that the Fourpoint antenna has about 20% of bandwidth at VSWR≧2. Note that the height "h" of the Foursquare antenna listed in Table 1 is about $0.16\lambda_U$ rather than $0.25\lambda_U$ as mentioned in association with FIGS. 17A and 17B. These data came from an early model with non optimized geometry. About 20% more bandwidth can be achieved by changing the height into about $0.25\lambda_U$.

TABLE 2

Measured and Computed Performance of the Foursquare Antenna

| Description | Symbol | Performance Measured | Performance Simulated |
|---|---|---|---|
| Lowest frequency at VSWR = 2 | $f_L$ (VSWR = 2) | 5.5 GHz | 5.4 GHz |
| Upper frequency at VSWR = 2 | $f_U$ (VSWR = 2) | 6.7 GHz | 6.65 GHz |
| Percent bandwidth | Bp | 19.7% | 20.7% |
| Element size in $\lambda_L$ | A | 0.39 $\lambda_L$ | 0.38 $\lambda_L$ |
| Substrate size in $\lambda_L$ | C | 0.4 $\lambda_L$ | 0.39 $\lambda_L$ |
| Height h in $\lambda_L$ | h | 0.13 $\lambda_L$ | 0.127 $\lambda_L$ |
| Beam width of E-plane at $f_L$ | $HP_E$ at $f_L$ | ≈60° | ≈60° |
| Beam width of H-plane at $f_L$ | $HP_H$ at $f_L$ | ≈70° | ≈70° |
| Beam width of E-plane of E-plane at $f_U$ | $HP_E$ at $f_U$ | ≈60° | ≈60° |
| Beam width of H-plane at $f_U$ | $HP_H$ at $f_U$ | ≈70° | ≈70° |

Figure 20A:
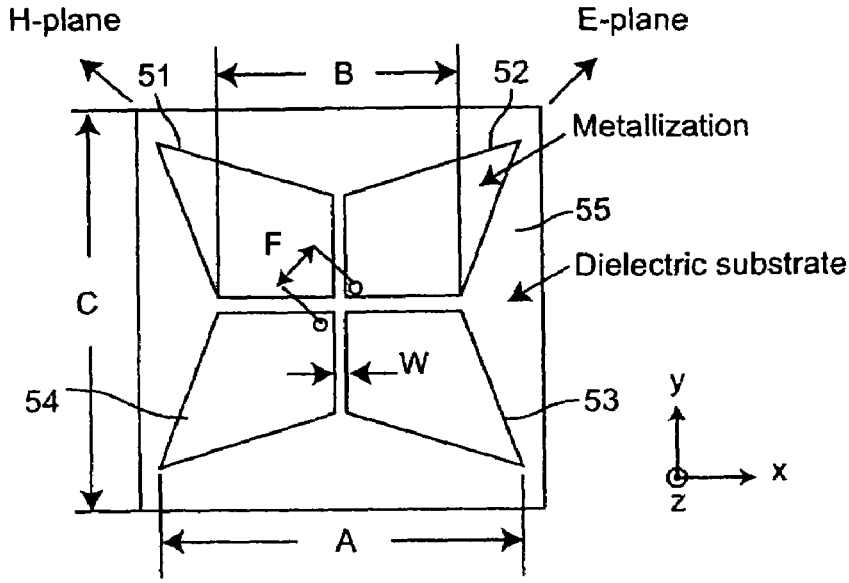
FIG. 20A is a top view of the Fourpoint antenna according to a second embodiment of the invention.
Figure 20B:
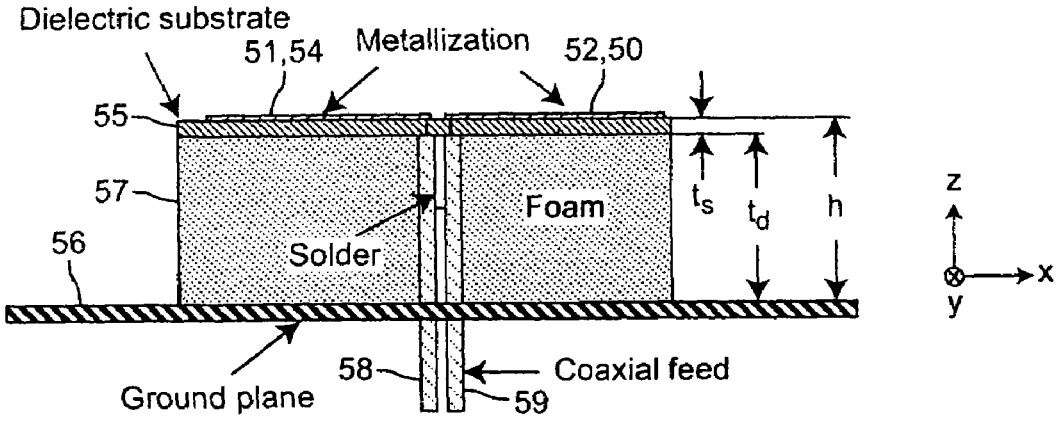
FIG. 20B is a side view of the Fourpoint antenna according to the second embodiment of the invention.

The geometry of the Fourpoint antenna is shown in FIGS. 20A and 20B. Essentially, the geometry of this antenna is based on the Foursquare antenna shown in FIGS. 17A and 17B, but provides significantly improved impedance bandwidth. The antenna has four metalization areas 51, 52, 53, and 54 on a dielectric substrate 55, as in the Foursquare antenna, but each of the metalizations in the Four point antenna comprise two short sides with an included right angle and two longer sides with an included acute angle. Eliminating the right angle at the outer corners of Foursquare antenna yields an antenna that has four points rather than four squares. The dielectric substrate 55 is separated from a ground plane 56 by a distance $t_d$ so that the sum of the thickness $t_s$ of the dielectric substrate and the distance $t_d$ is equal to the distance "h". The space between the ground plane 56 and the dielectric substrate is filled with a foam 57, and diametrically opposite ones of a pair of metalizations 51, 53 and/or 52, 54 are fed by coaxial feed lines 57 and 58.

The new antenna geometry increases capacitive reactance at the high frequency band, balancing the inductive reactance component of the antenna impedance over the operating band; that is, the reactance components are equally distributed over the band. The remainder of the geometry is similar to the Foursquare antenna except for the height "h" of the radiating element above the ground plane. The Foursquare antenna performance is optimum for a height about $h=\lambda_U/4$, where $\lambda_U$ represents a wavelength at the upper operating frequency. However, the Fourpoint antenna provides the best impedance bandwidth at about $h=\lambda_C/4$, where $\lambda_C$ is a wavelength at the center frequency of the operating band. The Fourpoint shape can also provide better performance in array system because there is less coupling between adjacent elements.

A test model of the Fourpoint antenna shown in FIGS. 20A and 20B was computed using the Fidelity code (Fidelity User's Manual, Zeland Software Inc., Release 3, 2000). For the purpose of the comparison, outer dimensions as for Foursquare antenna in FIGS. 17A and 17B, were used. The dimensions of the Fourpoint antenna are listed in Table 3.

TABLE 3

Geometry of the Foursquare Antenna of FIGS. 20A and 20B

| Description | Symbol | Size |
|---|---|---|
| Element side length | A | 21.3 mm (0.84") |
| Length B | B | 15.7 mm (0.62") |
| Substrate side length | C | 21.8 mm (0.86") |
| Gap width | W | 0.25 mm (0.01") |
| Substrate thickness | $t_s$ | 0.7 mm (0.028") |
| Foam thickness | $t_d$ | 6.4 mm (0.25") |
| Element height above ground plane | h | 7.06 mm (0.278") |
| Feed position distance | F' | 4.3 mm (0.17") |

Figure 21A:
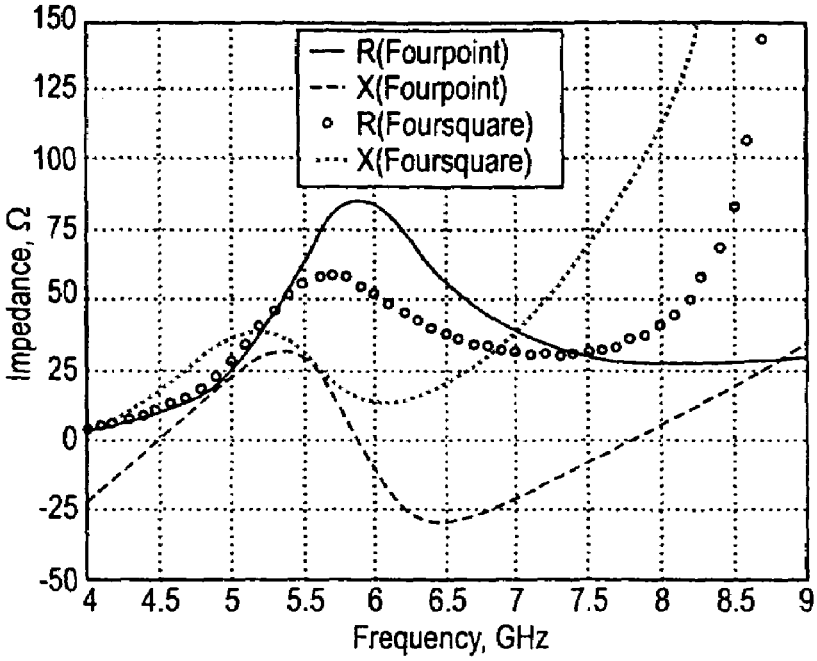
FIG. 21A is a graph showing computed antenna impedance curves of the Foursquare antenna in FIGS. 17A and 17B (circles and crosses) and the Fourpoint antenna in FIGS. 20A and 20B (solid and dashed curves) with the dimensions of Table 3.
Figure 21B:
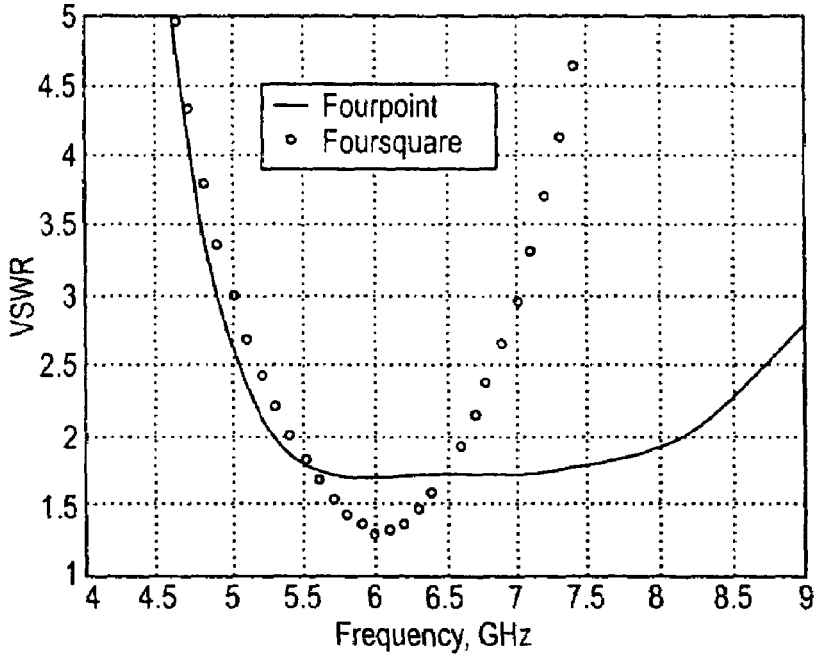
FIG. 21B is a graph showing computed VSWR curves (for 50 Ω) of the Foursquare antenna in FIGS. 17A and 17B (circles) and the Fourpoint antenna in FIGS. 20A and 20B (solid curve) with the dimensions of Table 3.

Antenna impedance and VSWR curves of the Foursquare and Fourpoint antennas are compared in FIGS. 21A and 21B. The VSWR curves are referenced to a 50 Ω input impedance. The impedance curves in FIG. 21A demonstrate that the Fourpoint antenna has better impedance characteristics than the Foursquare antenna; that is, the reactive component of the Fourpoint antenna impedance remains within ±25 Ω and the resistive component is well matched with a value close to 50 Ω. The Fourpoint antenna impedance bandwidth for VSWR≦2 is 44%, which is more than twice that of the Foursquare antenna bandwidth of 20%. This is accomplished with an outer dimension of the Fourpoint antenna that is exactly the same as that for the Foursquare antenna.

Figure 19A:
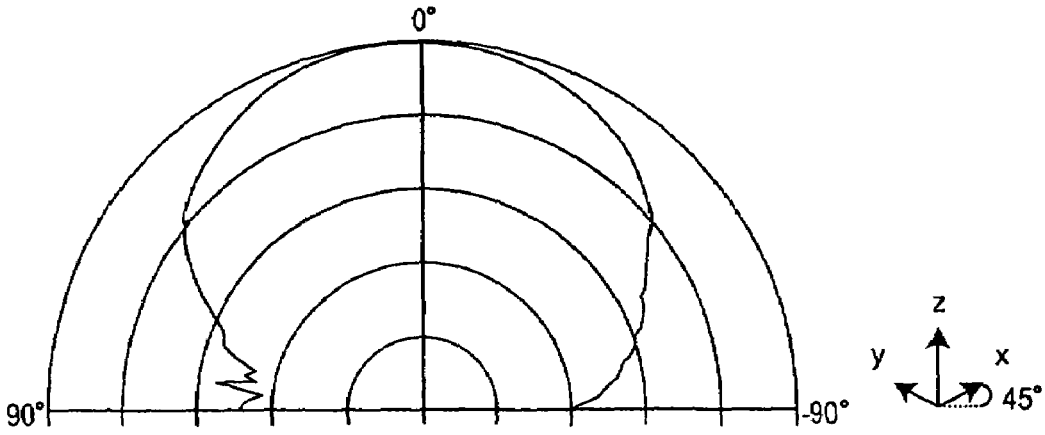
Figure 19A PRIOR ART
FIG. 19A is a polar graph showing a measured E-Plane nomialized radiation pattern at 6 Ghz (10 dB/division) of the Foursquare antenna in FIGS. 17A and 17B with the dimensions of Table 1.
Figure 19B:
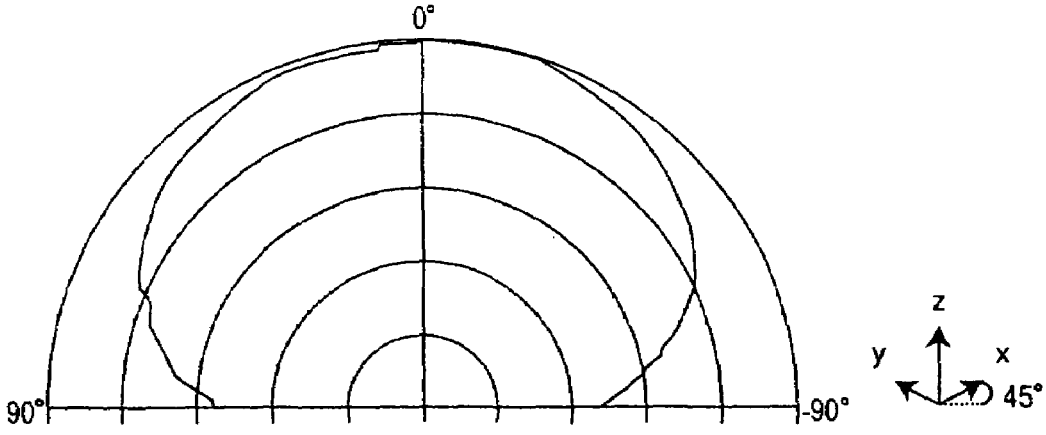
Figure 19B PRIOR ART
FIG. 19B is a polar graph showing a measured H-Plane normalized radiation pattern at 6 Ghz (10 dB/division) of the Foursquare antenna in FIGS. 17A and 17B with the dimensions of Table 1.

The radiation patterns of the Fourpoint antenna from simulations (not presented here) are similar to the pattern of the Foursquare antenna in FIGS. 19A and 19B.

The Fourpoint antenna described above and shown in FIGS. 20A and 20B can be improved by etching a tuning plate on bottom of the dielectric substrate. The tuning plate can also be used in the Foursquare antenna as we will demonstrate. The tuning plate provides another resonance at the high end of the operating band so that the bandwidth is significantly increased.

Figure 22A:
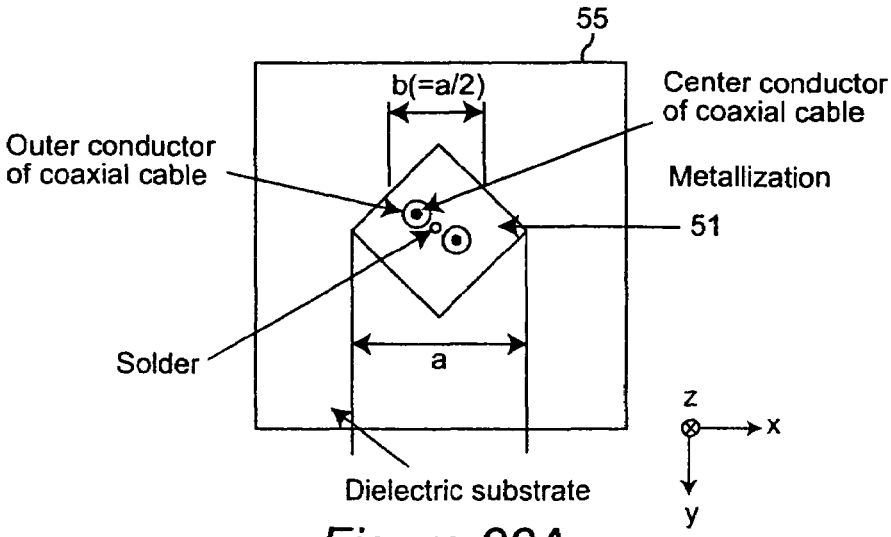
FIG. 22A is a bottom view of the Fourpoint antenna with a square-shaped tuning plate according to the modification of the second embodiment of the invention shown in FIG. 20A.
Figure 22B:
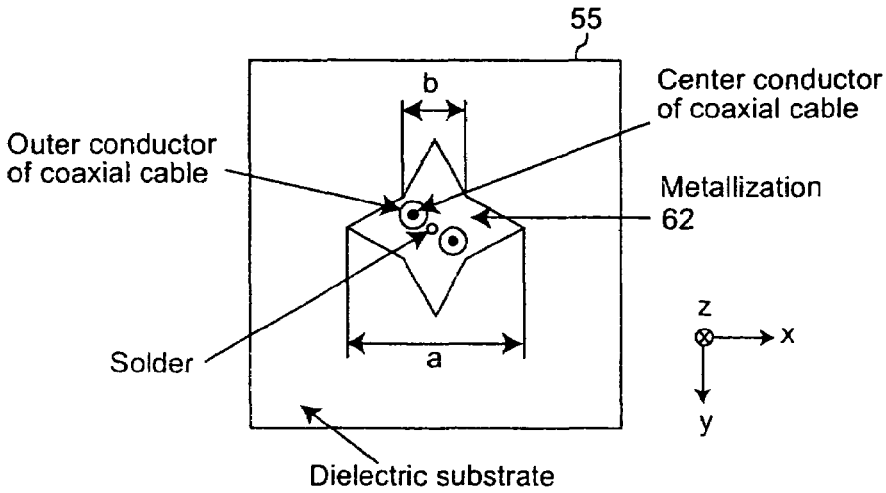
FIG. 22B is a bottom view of the Fourpoint antenna with a star-shaped tuning plate according to the modification of the second embodiment of the invention in FIG. 20A.
Figure 22C:
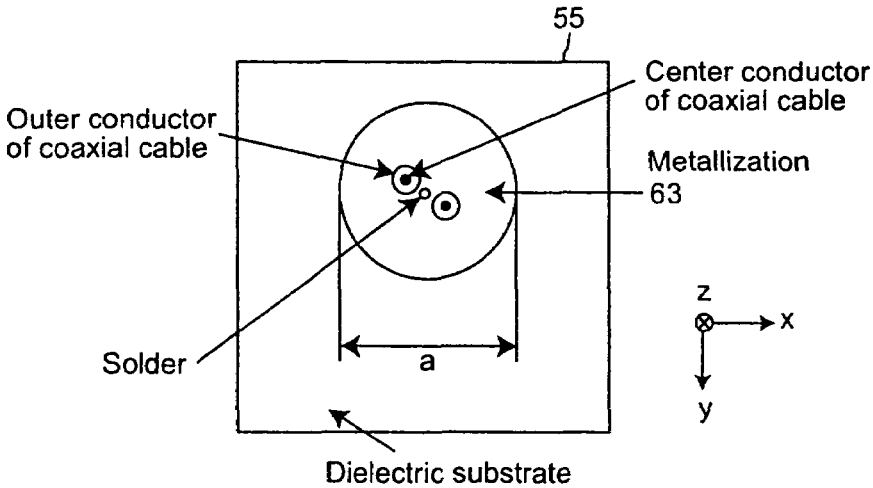
FIG. 22C is a bottom view of the Foursquare antenna with a circular tuning plate according to the modification of the second embodiment of the invention in FIG. 20A.
Figure 23A:
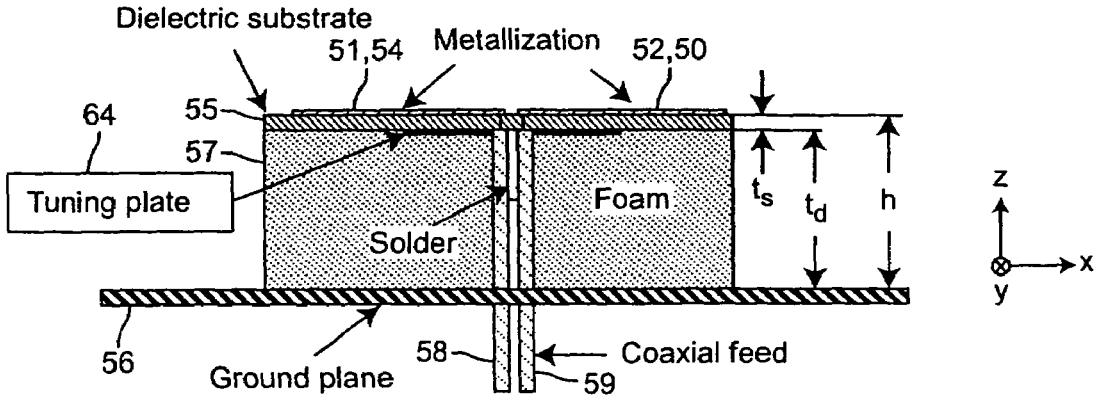
FIG. 23A is a side view of the Fourpoint antenna with single tuning plate according to the modification of the second embodiment of the invention in FIG. 20A.

FIGS. 22A to 22C show the bottom side of the dielectric substrate 55 of the Fourpoint antenna shown in FIG. 20A. The tuning plate can have any of a variety of shapes. FIG. 22A shows a tuning plate 61 having a square shape. FIG. 22B shows a tuning plate 62 have a star shape. FIG. 22C shows a tuning plate 63 having a circular shape. These are but three examples, and the shape chosen will depend on the application. As shown in FIG. 23A, the tuning plate 64 is etched on the bottom of the dielectric substrate 55 and is soldered to the outer conductors of the coaxial feed lines 58 and 59. Here the reference numeral 64 represents any of the shapes of tuning plates 61, 62, or 63 or any other shape that may be chosen for a particular application. The performance enhancement of the Fourpoint and Foursquare antenna with square-shaped, a star-shaped, and a circular tuning plate are presented. Generally, the size of the tuning plate is smaller than that of a radiating element so that it tunes the impedance at the high end of the operating band.

In addition to the tuning plate shape, the orientation of the tuning plate affects the performance of the antenna for tuning plates other than circular tuning plates. The best performance is obtained by rotating the tuning plate 45° from the Fourpoint radiating element vertices as illustrated in FIGS. 22A, 22B, and 22C.

Figure 23B:
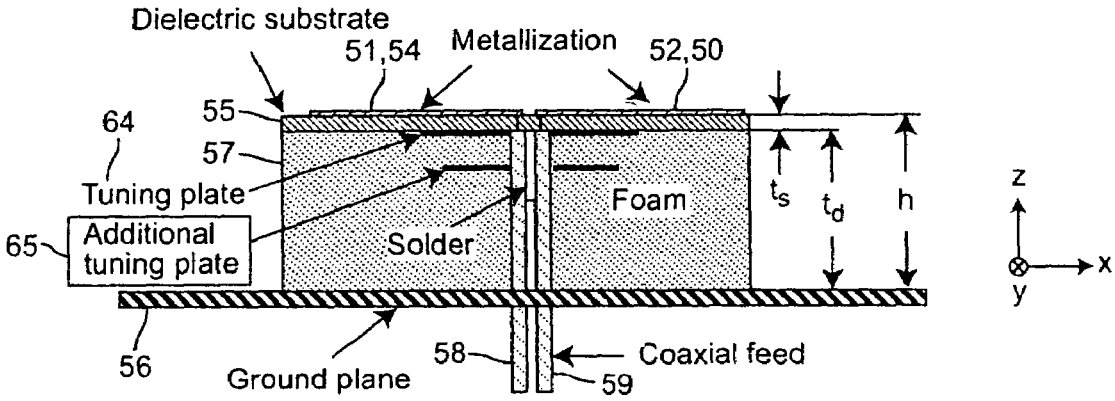
FIG. 23B is a side view of the Fourpoint antenna with multiple tuning plates according to a further modification of the second embodiment of the invention in FIG. 20A.

Additional tuning plate(s) 65, as shown in FIG. 23B, can be added at a position between the radiating elements 51, 52, 53, and 54 and the ground plane 55. The additional tuning plate 65 can be used to tune the impedance at another frequency.

Hardware test model of the Fourpoint antenna with a square-shaped tuning plate shown in FIG. 22A and with dimensions listed in Table 4 was investigated using both simulation and measurement. The dielectric constant of the dielectric substrate was 2.33 in both simulation and measurements. An infinite ground plane rather than finite ground plane was used in the simulation to minimize the computing time. A finite ground plane size of the about 2.5 times the size of the radiating element was used in measurement. Generally, the ground plane should be about twice the radiating element.

TABLE 4

Geometry of the Fourpoint Antenna of FIG. 22A

| Description | Symbol | Size |
|---|---|---|
| Element side length | A | 114.3 mm (4.5") |
| Length B | B | 95.25 mm (3.75") |
| Substrate side length | C | 117 mm (4.6") |
| Tuning plate outer dimension a | a | 40.64 mm (1.6") |
| Tuning plate inner dimension b | b | 20.32 mm (0.8") |
| Gap width | W | 2.03 mm (0.08") |
| Substrate thickness | $t_s$ | 1.57 mm (62 mils) |
| Foam thickness | $t_d$ | 62.48 mm (2.46") |
| Element height above ground plane | h | 64.06 mm (2.522") |
| Feed position distance | F' | 5.03 mm (0.197") |

Impedance and VSWR curves referenced to 50 Ω for the test model Fourpoint antenna in FIG. 22A are plotted in FIG. 23 and the computed and measured performance data are summarized in Table 5. Excellent agreement between the calculation and measure data was demonstrated.

Figure 18A:
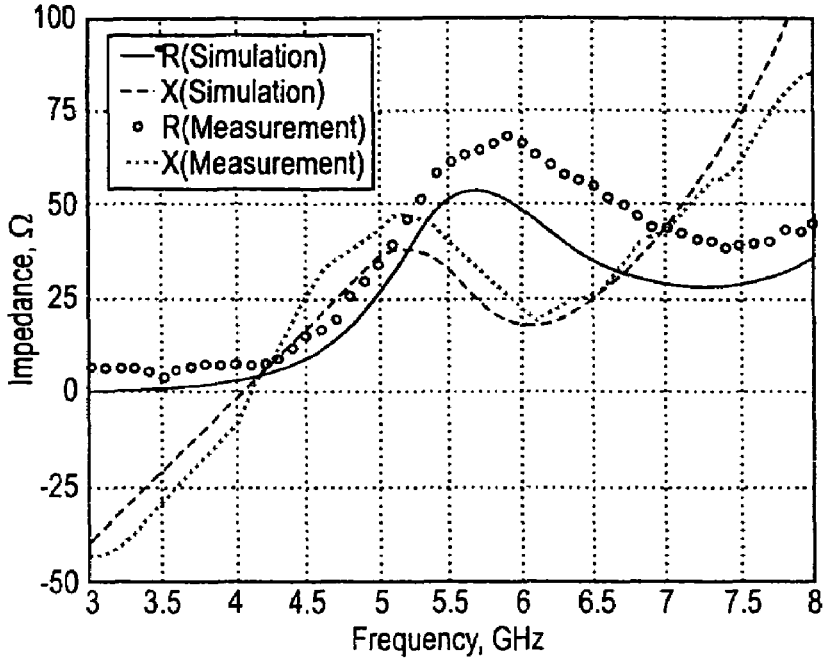
Figure 18A PRIOR ART
FIG. 18A is a graph showing computed and measured impedance for the Foursquare antenna shown in FIGS. 17A and 17B.
Figure 18B:
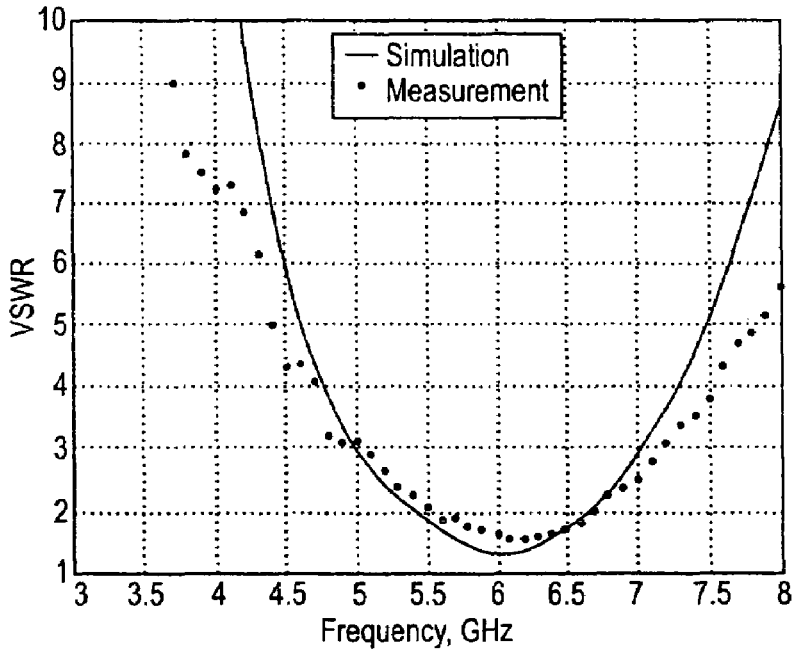
Figure 18B PRIOR ART
FIG. 18B is a graph showing computed and measured VSWR for 50 Ω of the Foursquare antenna shown in FIGS. 17A and 17B.
Figure 24A:
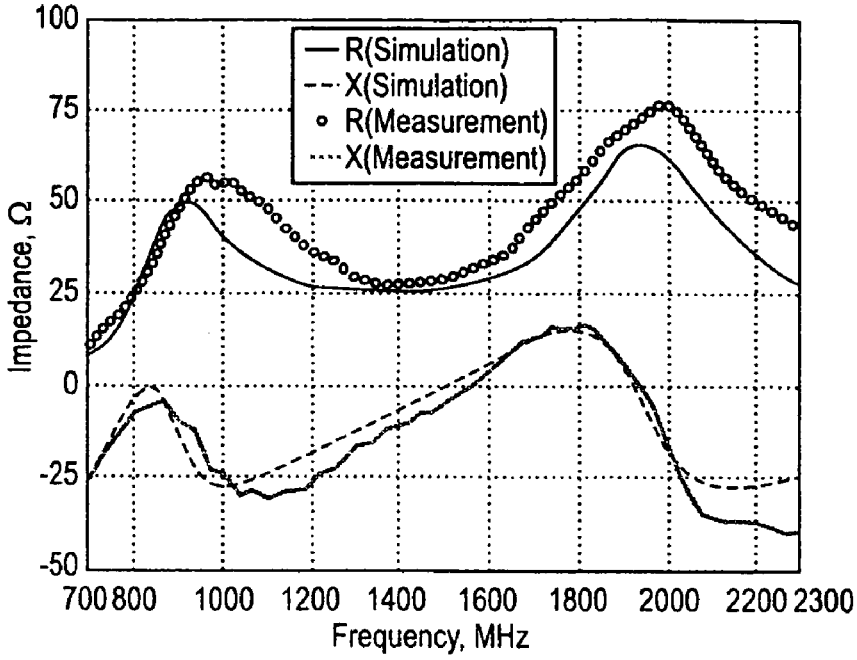
FIG. 24A is a graph showing computed (solid and dashed) and measured (circle and cross) antenna impedance curves for the Fourpoint antenna of FIG. 22B with the dimensions of Table 4.
Figure 24B:
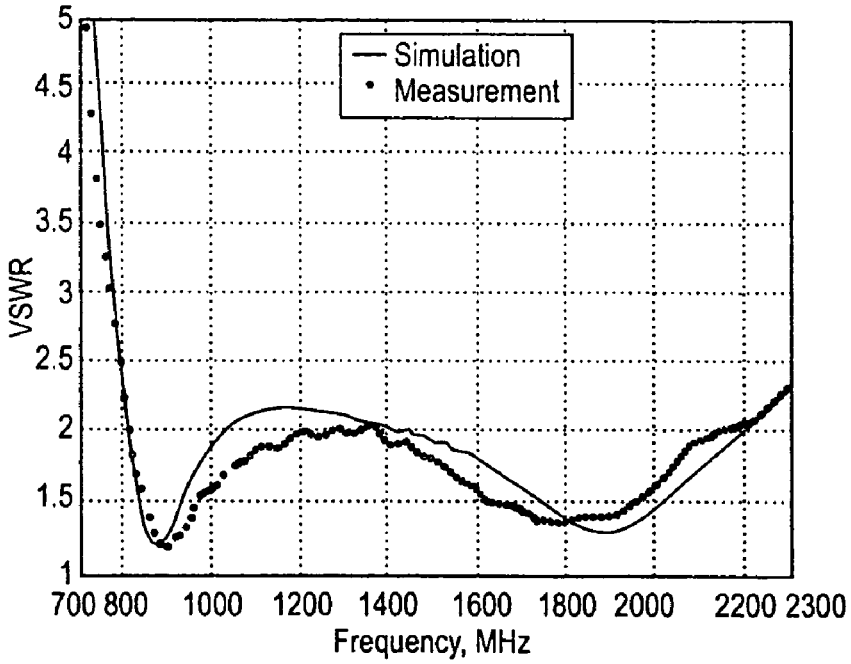
FIG. 24B is a graph showing computed (solid) and measured (dotted) VSWR (for 50 Ω) curves for the Fourpoint antenna of FIG. 22B with the dimensions of Table 4.

In FIG. 24A, dual resonance is observed at the low and high end of the operating band and the impedance is balanced close to 50 Ω for the resistance and 0 Ω for the reactance. This Fourpoint antenna with a square tuning plate has 2.7:1 (92%) bandwidth at VSWR≦2. This is a dramatic improvement over the Foursquare antenna of prior art shown in FIGS. 18A and 18B which has a bandwidth of 20%.

Figure 24C:
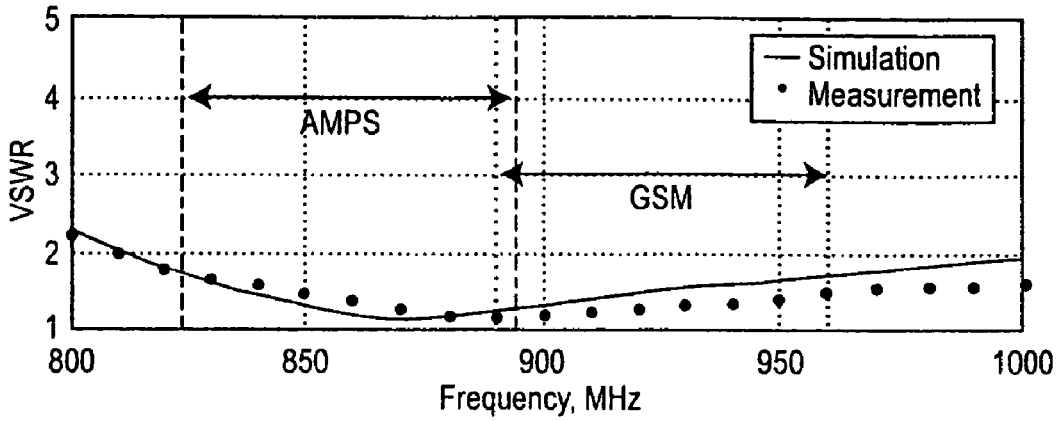
FIGS. 24C and 24D are graphs showing computed and measured values of VSWR at AMPS, GSM, DCS, and PCS bands for the Fourpoint antenna of FIG. 22B with the dimensions of Table 4.
Figure 24D:
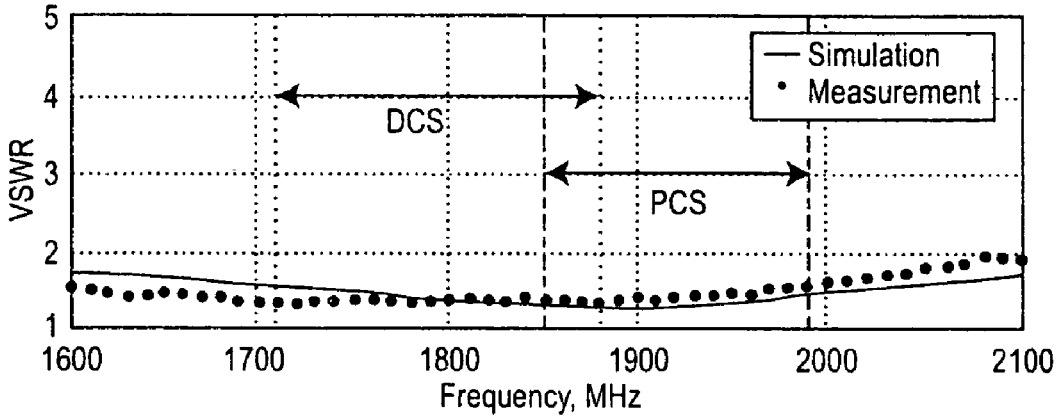

The large bandwidth with compact size of the Fourpoint antenna makes it ideal as a multiple band base station antenna. For example, it is capable of covering the AMPS, GSM, DCS, and PCS services as shown in FIGS. 24C and 24D. The antenna can also provide dual linear polarization to support diversity. As far as inventors know, there is no antenna used in commercial or military applications that has 2.7:1 bandwidth and dual linear polarization in a low-profile package.

Radiation patterns were also measured for several frequencies in the anechoic chamber of Virginia Tech Antenna Group (VTAG) using a near field scanner. The radiation patterns in FIGS. 25A and 25B do not change significantly as the frequency increases, which also is a very desirable feature. The H-plane pattern is broader than the E-plane pattern, specially at the high end of the band. Also, the H-plane patterns develop a dip on axis at the high end of the band but this is acceptable in may applications. However, the E-and H-plane patterns are not significantly different and are relatively broad, which is ideal for wide-scan phased array applications. The gain of the Fourpoint antenna at boresight remains to be measured, but since the Foursquare antenna has about 8–9 dBi peak gain over the band and we could expect the Fourpoint antenna to have the same peak gain, the gain at boresight should be at least 1–2 dBi.

TABLE 5

Figure 25A:
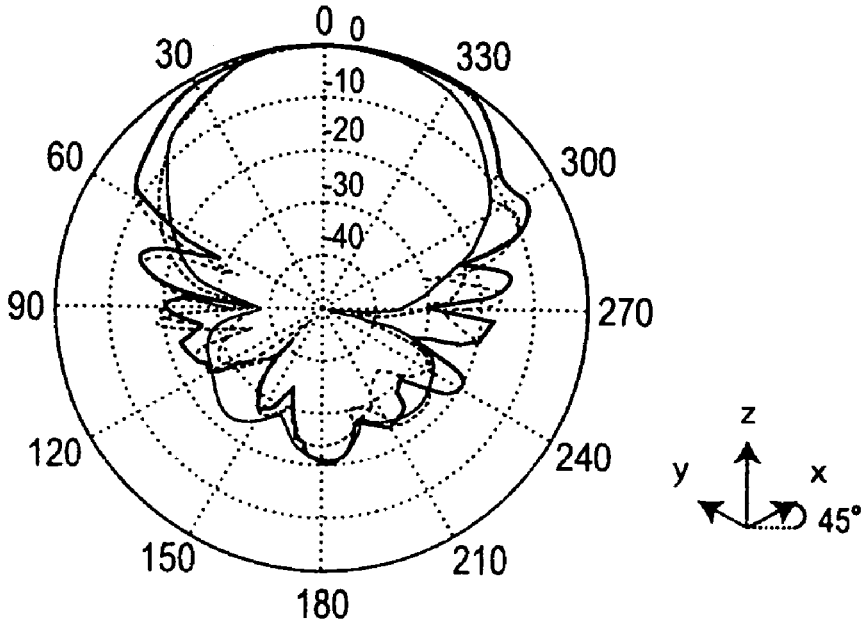
FIG. 25A is a polar graph of a measured E-plane normalized radiation patterns at 900 MHz (solid), 950 MHz (dashed), 1800 MHz (dash-dotted), and 1900 MHz (dotted) (10 dB/division) of the Fourpoint antenna with a square-shaped tuning plate in FIG. 22A with the dimensions of Table 4.
Figure 25B:
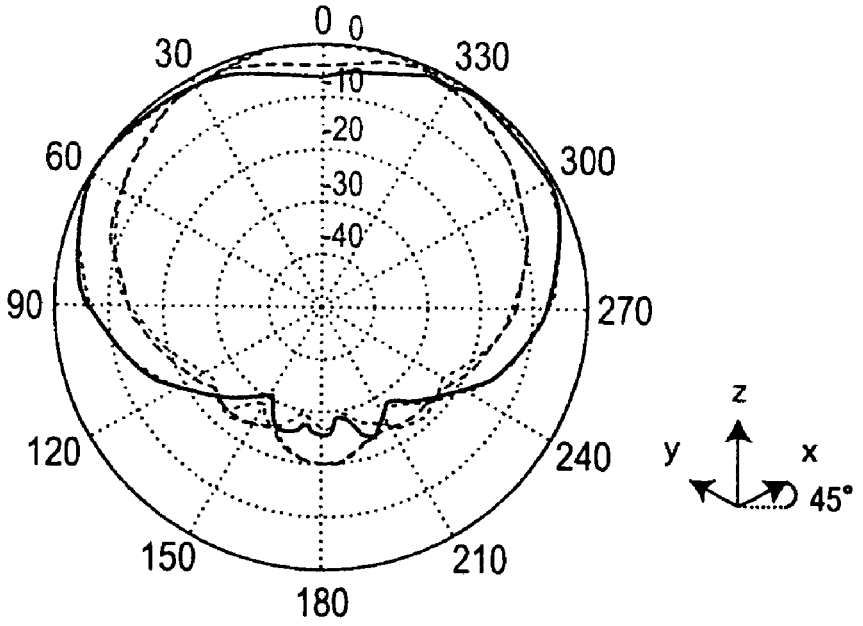
FIG. 25B is a polar graph showing a measured H-plane normalized radiation patterns at 900 MHz (solid), 950 MHz (dashed), 1800 MHz (dash-dotted), and 1900 MHz (dotted) (10 dB/division) of the Fourpoint antenna with a square-shaped tuning plate in FIG. 22A with the dimensions of Table 4.

Measured and Computed Performance of the Fourpoint Antenna with a Square Tuning Plate (Geometry: FIG. 22A, Performance curves: FIGS. 24A to 24D; Pattern: FIGS. 25A and 25B)

| Description | Symbol | Performance Measured | Performance Simulated |
|---|---|---|---|
| Lowest frequency at VSWR = 2 | $f_L$ (VSWR = 2) | 805 MHz | 805 MHz |
| Upper frequency at VSWR = 2 | $f_U$ (VSWR = 2) | 2190 GHz | 2200 MHz |
| Percent bandwidth | Bp | 92.5% | 92.9% |
| Ratio bandwidth | Br | 2.72:1 | 2.73:1 |
| Element size in $\lambda_L$ | A | 0.306 $\lambda_L$ | 0.306 $\lambda_L$ |
| Substrate size in $\lambda_L$ | C | 0.314 $\lambda_L$ | 0.314 $\lambda_L$ |
| Height h in $\lambda_L$ | h | 0.172 $\lambda_L$ | 0.172 $\lambda_L$ |
| Beam width of E-plane at $f_L$ | $HP_E$ at $f_L$ | ≈50° | ≈50° |
| Beam width of H-plane at $f_L$ | $HP_H$ at $f_L$ | ≈65° | ≈65° |
| Beam width of E-plane of E-plane at $f_U$ | $HP_E$ at $f_U$ | ≈80° | ≈80° |
| Beam width of H-plane at $f_U$ | $HP_H$ at $f_U$ | ≈150° | ≈150° |

A hardware test model of the Fourpoint antenna with a star-shaped tuning plate (FIG. 22B) was also investigated. The Fourpoint antenna geometry with a star-shaped tuning plate has dimensions listed in Table 6. The Fourpoint antenna was designed for operation between 6–12 Ghz, so the antenna size is smaller than the antenna size in Table 4. The height "h" is about 0.27λc in this test model, where λc represents wavelength at the center frequency. A substrate dielectric constant 2.33 was used. Both simulation and experimental evaluation were performed. An electrical large ground plane was used in measurements.

TABLE 6

Geometry of the Fourpoint Antenna of FIGS. 22A, C and E

| Description | Symbol | Size |
|---|---|---|
| Element side length | A | 17.02 mm (0.67") |
| Length B | B | 13.97 mm (0.55") |
| Substrate side length | C | 17.3 mm (0.68") |
| Tuning plate outer dimension a | a | 11.18 mm (0.44") |
| Tuning plate inner dimension b | b | 4.57 mm (0.18") |
| Gap width | W | 0.508 mm (0.02") |
| Substrate thickness | $t_s$ | 0.787 mm (31 mils) |
| Foam thickness | $t_d$ | 7.92 mm (0.312") |
| Element height above ground plane | h | 8.71 mm (0.343") |
| Feed position distance | F' | 2.87 mm (0.113") |

Figure 26A:
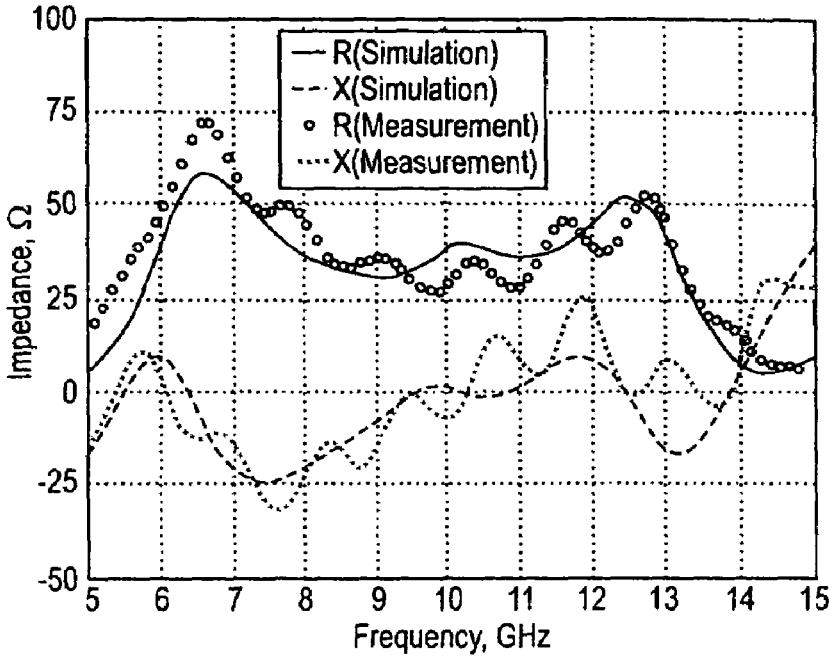
FIG. 26A is a graph showing a computed (solid and dashed) and measured (circle and cross) antenna impedance curves for the Fourpoint antenna with star-shaped tuning plate of FIG. 22B with the dimensions of Table 6.
Figure 26B:
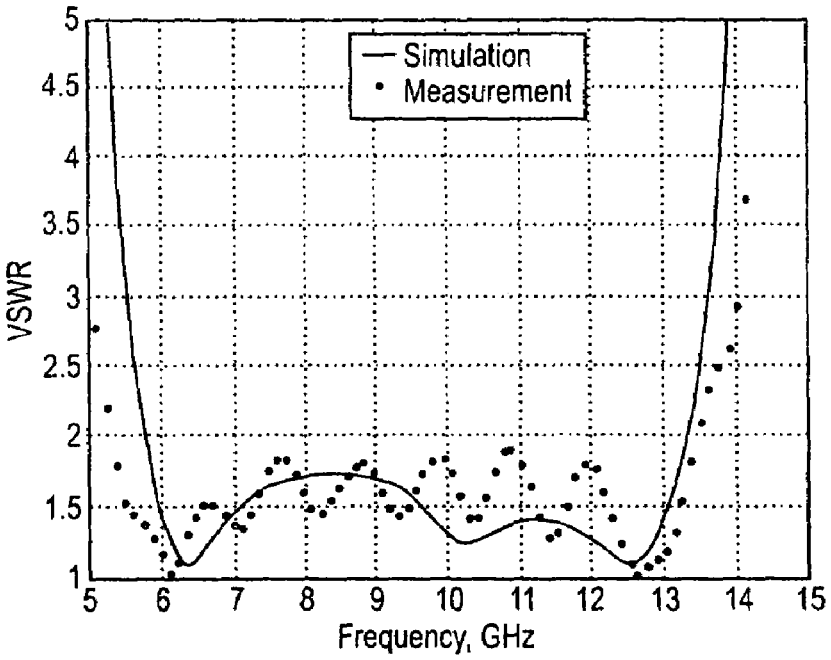
FIG. 26B is a graph showing computed (solid) and measured (dotted) VSWR (for 50 Ω) curves for the Fourpoint antenna with star-shaped tuning plate of FIG. 22B with the dimensions of Table 6.

The performance of the Fourpoint antenna is summarized in Table 7 and the computed and measured antenna impedance and VSWR curves are shown in FIGS. 26A and 26B. They show excellent agreement each other and the Fourpoint antenna covers 5.3–13.5 Ghz, giving a 2.6:1 (87%) bandwidth for VSWR≦2. Again this antenna provides dual polarization in a single antenna element.

The radiation patterns are not presented in this disclosure, but they are similar to the patterns in FIGS. 25A and 25B.

TABLE 7

Measured and Computed Performance of the Fourpoint Antenna with a Star-shaped Tuning Plate (Geometry: FIG. 22B, Performance curves: FIG. 26A and 26B)

| Description | Symbol | Performance Measured | Performance Simulated |
|---|---|---|---|
| Lowest frequency at VSWR = 2 | $f_L$ (VSWR = 2) | 5.3 GHz | 5.8 GHz |
| Upper frequency at VSWR = 2 | $f_U$ (VSWR = 2) | 13.5 GHz | 13.3 MHz |
| Percent bandwidth | Bp | 87% | 78.5% |
| Element size in $\lambda_L$ | A | 0.3 $\lambda_L$ | 0.329 $\lambda_L$ |
| Substrate size in $\lambda_L$ | C | 0.31 $\lambda_L$ | 0.334 $\lambda_L$ |
| Height h in $\lambda_L$ | h | 0.154 $\lambda_L$ | 0.17 $\lambda_L$ |

Since the tuning plate performed so well with the Fourpoint antenna, the Foursquare antenna with tuning plate was also examined. The Foursquare antenna shown in FIG. 17A with a circular tuning plate added as in FIGS. 23A and 23B with dimensions of Table 8 was simulated. In order to demonstrate the effect of the tuning plate, we also simulated the Foursquare antenna without a tuning plate and the same outer dimensions as listed in Table 8. Note that the outer dimensions of Foursquare radiating element in Table 8 are smaller than the dimensions in Table 2, and the height "h" was optimized to 0.234 λc and 0.24 $\lambda_U$ for each antenna with and without a circular tuning plate, respectively.

TABLE 8

Figure 17A:
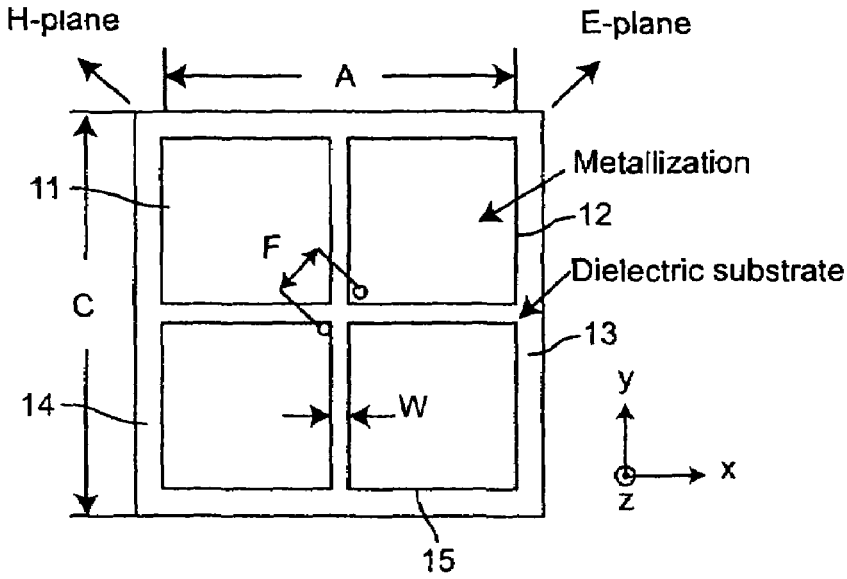
Figure 17A PRIOR ART
FIG. 17A is a top view of the Foursquare antenna described by the prior art.
Figure 17B:
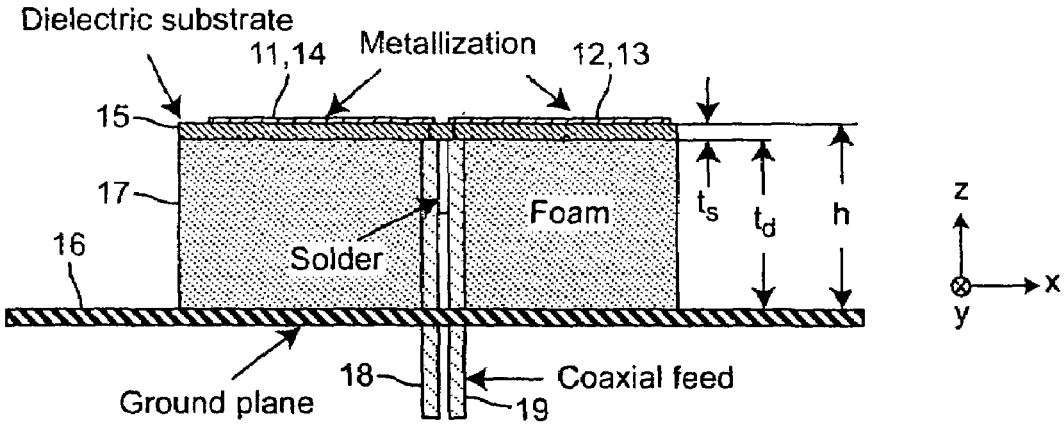
Figure 17B PRIOR ART
FIG. 17B is a side view of the Foursquare antenna taught by the prior art.

Geometry of the Foursquare Antenna of FIG. 17A with a Circular Tuning Plate in FIG. 22C

| Description | Symbol | Size |
|---|---|---|
| Element side length | A | 17.02 mm (0.67") |
| Substrate side length | C | 17.3 mm (0.68") |
| Circular plate diameter | a | 8.13 mm (0.32") |
| Gap width | W | 0.508 mm (0.32") |
| Substrate thickness | $t_s$ | 0.787 mm (31 mils) |
| Foam thickness | $t_d$ | 7.92 mm (0.312") |

TABLE 8-continued

| Geometry of the Foursquare Antenna of FIG. 17A with a Circular Tuning Plate in FIG. 22C | | |
|---|---|---|
| Description | Symbol | Size |
| Element height above ground plane | h | 8.71 mm (0.343") |
| Feed position distance | F' | 4.31 mm (0.17") |

Figure 27A:
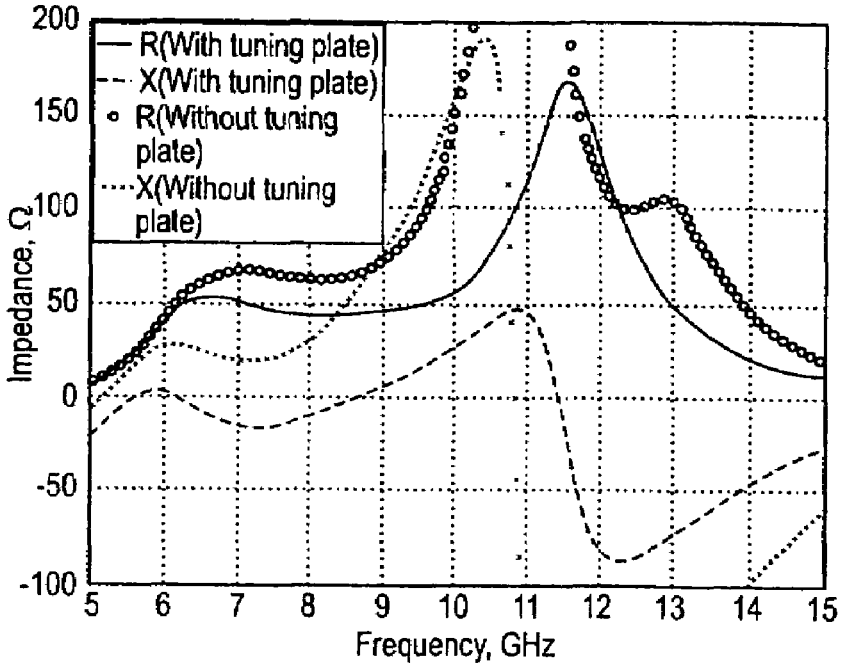
FIG. 27A is a graph showing computed antenna impedance curves for the Foursquare antenna with and without a circular tuning plate in FIG. 22C with dimensions of Table 8.
Figure 27B:
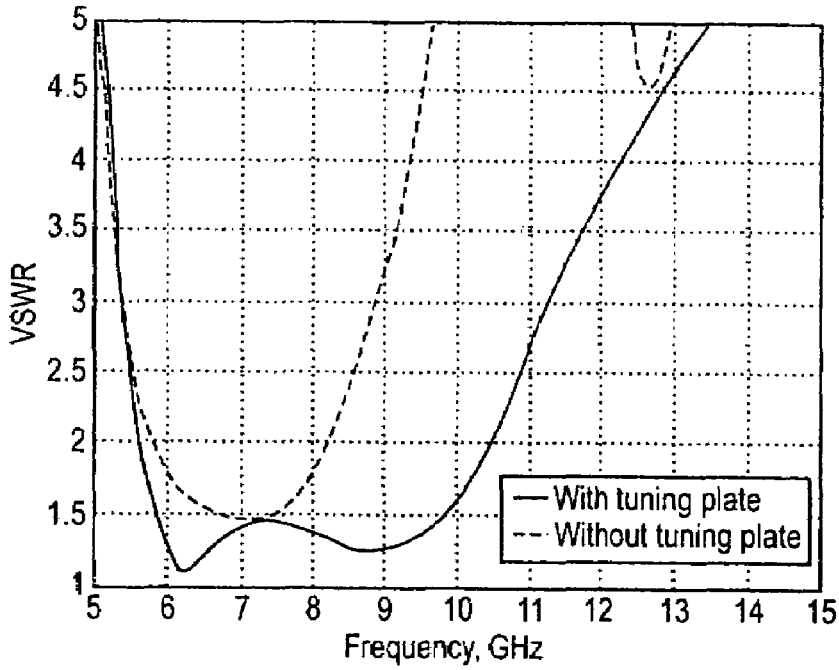
FIG. 27B is a graph showing computed VSWR (for 50 Ω) curves for the Foursquare antenna with and without a circular tuning plate in FIG. 22C with dimensions of Table 8.

The performance with and without a tuning plate is summarized in Table 9 and the computed antenna impedance and VSWR curves are shown in FIGS. 27A and 27B. The performance is enhanced in the Foursquare antenna by employing tuning plate as was found with the Fourpoint antenna. The circular tuning plate in the Foursquare antenna increased the bandwidth of the Foursquare antenna from 35% to 60% for VSWR≦2. The VSWR curve in FIG. 27B is referenced to a 50 Ω input impedance. Note that the Foursquare antenna (without tuning plate) in this embodiment has better bandwidth (35%) than the Foursquare antennas (20%) for the prior art. The bandwidth enhancement in this invention is due to the optimized height "h" to $0.24\lambda_U$ in the Foursquare antenna (without tuning plate) rather than the height $0.16\lambda_U$ of the antenna in prior art. The Foursquare antenna radiation patterns are similar to the patterns in FIGS. 19A and 19B.

TABLE 9

| Computed Performance of the Foursquare Antenna with and without Circular Tuning Plate (Geometry: FIGS. 17A and FIGS. 22C; Performance curves: FIG. 27A and 27B) | | | |
|---|---|---|---|
| Description | Symbol | Performance Simulated With circular tuning plate | Performance Simulated without circular tuning plate |
| Lowest frequency at VSWR = 2 | $f_L$ (VSWR = 2) | 5.65 GHz | 5.83 GHz |
| Upper frequency at VSWR = 2 | $f_U$ (VSWR = 2) | 10.53 GHz | 8.27 GHz |
| Percent bandwidth | Bp | 60.3% | 34.6% |
| Element size in $\lambda_L$ | A | 0.32 $\lambda_L$ | 0.331 $\lambda_L$ |
| Substrate size in $\lambda_L$ | C | 0.325 $\lambda_L$ | 0.336 $\lambda_L$ |
| Height h in $\lambda_L$ | h | 0.164 $\lambda_L$ | 0.169 $\lambda_L$ |

Several test models were investigated to evaluate the tuning plate effect on the Foursquare and the Fourpoint antennas. The calculated and measured results demonstrate that the tuning plate enhances the antenna performance significantly without increasing antenna size.

Figure 28:
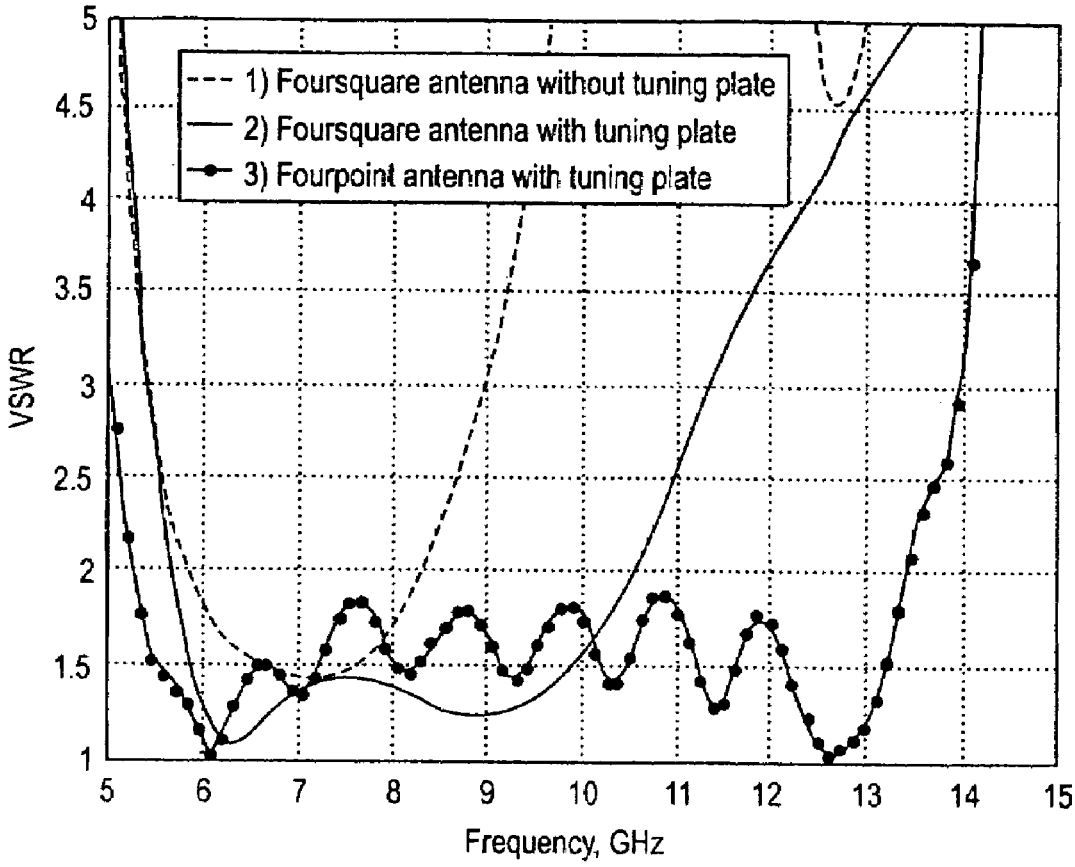
FIG. 28 is a graph showing computed and measured VSWR (for 50 Ω) curves of 1) the Foursquare antenna without tuning plate (dashed), 2) the Foursquare antenna with circular tuning plate (solid), and 3) the Fourpoint antenna with star-shaped plate (solid-dotted) having the same outer dimensions in Table 6 and 8.

FIG. 28 shows the comparison curves from VSWR data for antenna with dimensions listed in Tables 6 and 8, so a direct performance comparison can be made for three cases: 1) Foursquare antenna without tuning plate, 2) Foursquare antenna with a circular tuning plate, 3) Fourpoint antenna with a star-shaped tuning plate. Significant performance impedance bandwidth enhancement (from 35% to 87%) was achieved as shown in FIG. 28 with the Fourpoint antenna with the tuning plate.

The tuning plates in FIGS. 22A, 22B and 22C are just a few examples of plates examined in the investigation. Various geometries can be used to suit the application. Moreover, the tuning plate can be applied to any antenna with a geometry similar to the Foursquare or the Fourpoint antenna. Also, multiple tuning plates as in FIG. 23B cam also be used to widen the antenna impedance bandwidth further.

Figure 29A:
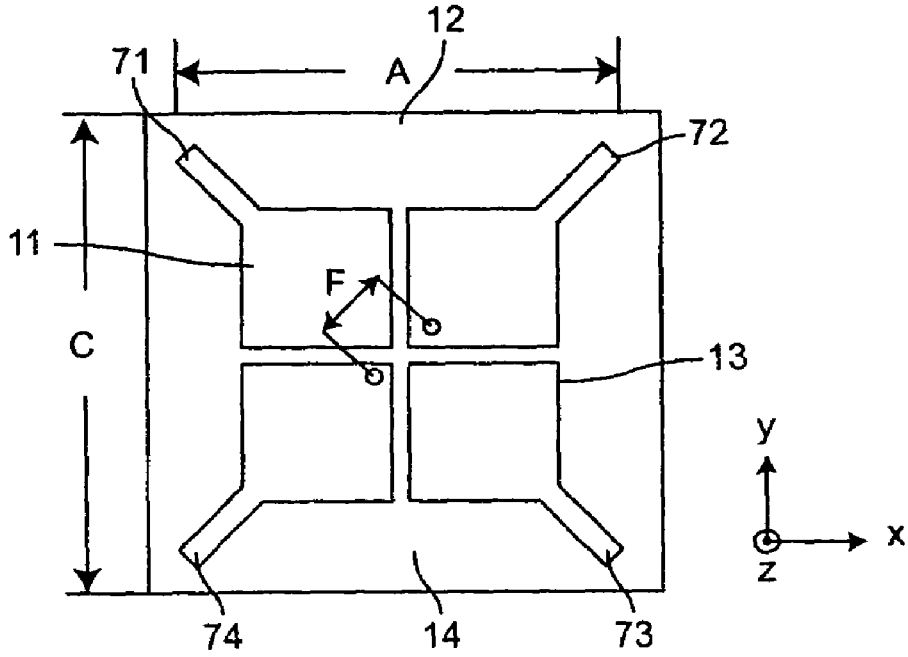
FIG. 29A is a top view showing a variation of the Foursquare radiating elements according to a further modification of the second embodiment of the invention.
Figure 29B:
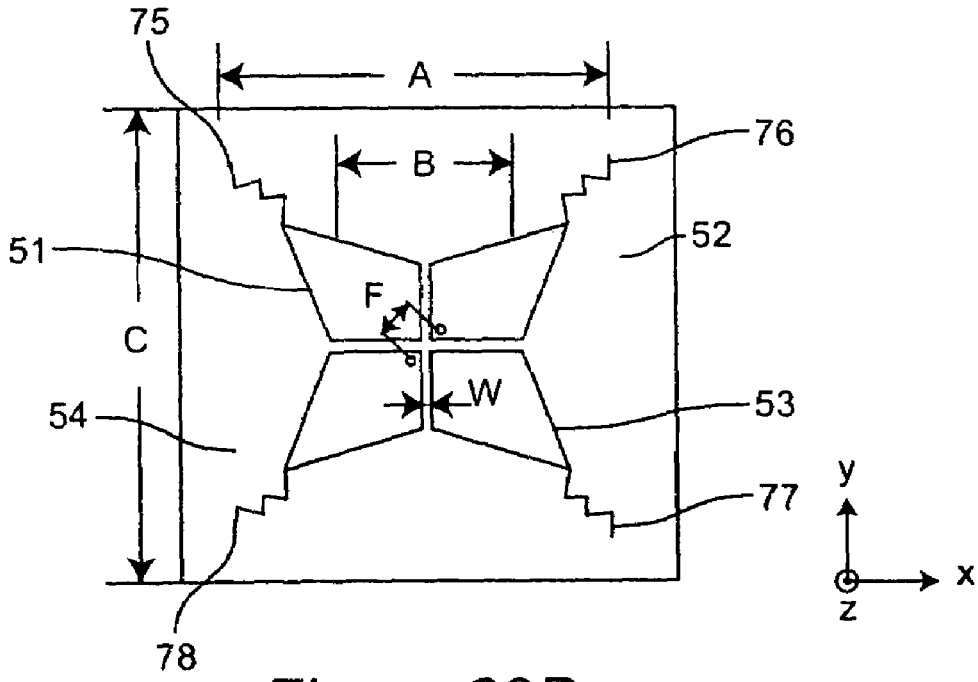
FIG. 29B is a top view showing a further variation of the Fourpoint radiating elements according to another modification of the second embodiment of the invention.

Furthermore, some variation of the Foursquare and the Fourpoint radiating elements are shown in FIGS. 29A and 29B. In FIG. 29A, rectangular metal tabs 71, 72, 73, and 74 are added to the vertices of the radiating elements 11, 12, 13, and 14, respectively. In FIG. 29B, zig-zag metal tabs 75, 76, 77, and 78 are added to the vertices of the radiating elements 51, 52, 53, and 54, respectively. The additional tabs can have a variety of geometries such as triangle, helix, thin wire, etc. They can be applied to both the Foursquare and Fourpoint radiating elements. The tabs reduce the antenna size and are useful for elements used in arrays because the mutual coupling between elements may be reduced.

Summarizing the information about Fourpoint antennas it should be noted that the Fourpoint antenna in FIG. 20A enhances the performance of the Foursquare antenna dramatically just by changing the "square" of the Foursquare antenna to a "point" shape. The Fourpoint antenna provides balanced impedance over the operating band, whereas the Foursquare antenna has an inductive reactance over its band. The Fourpoint antenna has useful radiation patterns and dual polarization over its operating frequency.

The Fourpoint and Foursquare antennas that include a tuning plate as in FIGS. 22A, 22B and 22C have significantly improved bandwidth through extension through extension of the high end of the frequency band. Measured and computed data in FIGS. 24A to 24D, FIGS. 25A and 25B, FIGS. 26A and 26B, and FIGS. 27A and 27B for the several test models document the performance enhancement with tuning plate. Multiple tuning plates can be employed to broaden the bandwidth.

Finally, variations of the Foursquare and Fourpoint radiation elements can reduce the antenna size while maintains similar antenna performance.

While the invention has been described in terms of preferred embodiments with various modifications, those skilled in the art will recognize that the invention can be practiced with modification within the spirit and scope of the appended claims.

The invention claimed is:

1. An antenna element, comprising:

a ground plane; and a flat radiating element perpendicular to the ground plane, said flat radiating element having a shape of an inverted cone intersecting an elliptical curve.

2. The antenna element as recited in claim 1, wherein said elliptical curve is semi-circular.

3. The antenna element as recited in claim 1, wherein said inverted cone is truncated to form an inverted trapezoid.

4. The antenna element as recited in claim 1, wherein a height of the flat radiating element measured from a base of the elliptical curve to an apex of the inverted cone is equal to a quarter wavelength of a lowest operating frequency of the antenna element.

5. The antenna element as recited in claim 1, further comprising a radiating element projecting from an apex of the inverted cone and functioning as a loading element.

6. The planar antenna as recited in claim 4, wherein said loading element is selected from the group comprising a straight wire, helix wire, zigzag wire, meander shaped wire, triangular shaped element, rectangular shaped element, or flat antenna of any shape.

7. An antenna element as recited in claim 1, further comprising a second flat radiating element perpendicular to the ground plane and perpendicular to said first mentioned flat radiating element, said second flat radiating element having a shape of an inverted cone intersecting an elliptical curve and identical in dimension to said first mentioned flat radiating element.

* * * * *

UNITED STATES PATENT AND TRADEMARK OFFICE

CERTIFICATE OF CORRECTION

PATENT NO. : 7,027,002 B2
APPLICATION NO. : 10/960488
DATED : April 11, 2006
INVENTOR(S) : Suh et al.

It is certified that error appears in the above-identified patent and that said Letters Patent is hereby corrected as shown below:

On the title page, item [75]: "Inventors", please replace "Seong-Youn Suh" with "Seong-Youp Suh"

Signed and Sealed this

Eighteenth Day of July, 2006

JON W. DUDAS
*Director of the United States Patent and Trademark Office*